US006899095B2

(12) United States Patent
Livchak et al.

(10) Patent No.: US 6,899,095 B2
(45) Date of Patent: May 31, 2005

(54) DEVICE AND METHOD FOR CONTROLLING/BALANCING FLOW FLUID FLOW-VOLUME RATE IN FLOW CHANNELS

(75) Inventors: Andrey Livchak, Bowling Green, KY (US); Derek Schrock, Bowling Green, KY (US)

(73) Assignee: Halton Company Inc., Scottsville, KY (US)

( * ) Notice: Subject to any disclaimer, the term of this patent is extended or adjusted under 35 U.S.C. 154(b) by 0 days.

(21) Appl. No.: 10/344,505

(22) PCT Filed: Aug. 10, 2001

(86) PCT No.: PCT/US01/25063

§ 371 (c)(1),
(2), (4) Date: Jun. 11, 2003

(87) PCT Pub. No.: WO02/14746

PCT Pub. Date: Feb. 21, 2002

(65) Prior Publication Data

US 2004/0035411 A1 Feb. 26, 2004

Related U.S. Application Data

(60) Provisional application No. 60/224,123, filed on Aug. 10, 2000, provisional application No. 60/226,953, filed on Aug. 22, 2000, and provisional application No. 60/263,557, filed on Jan. 23, 2001.

(51) Int. Cl.[7] ..... F24F 5/00

(52) U.S. Cl. ..... 126/299 D; 126/312

(58) Field of Search ..... 126/299 D, 299 R, 126/300, 301, 302, 303, 312

(56) References Cited

U.S. PATENT DOCUMENTS

| | | | | | |
|---|---|---|---|---|---|
| 3,323,439 | A | | 6/1967 | Waever et al. | |
| 4,155,348 | A | | 5/1979 | Ahlrich | |
| 4,160,407 | A | | 7/1979 | Duym | |
| 4,584,929 | A | | 4/1986 | Järmyr et al. | |
| 4,903,685 | A | | 2/1990 | Melink | |
| 5,394,861 | A | | 3/1995 | Stegmaier | |
| 5,522,377 | A | | 6/1996 | Fritz | |
| 5,713,346 | A | * | 2/1998 | Kuechler | 126/299 D |
| 5,718,219 | A | * | 2/1998 | Boudreault | 126/299 E |
| 5,720,274 | A | * | 2/1998 | Brunner et al. | 126/299 D |
| 5,764,579 | A | | 6/1998 | McMasters et al. | |
| 5,874,292 | A | * | 2/1999 | McMinn, Jr. | 435/262 |
| 5,960,786 | A | | 10/1999 | Lambertson | |

FOREIGN PATENT DOCUMENTS

JP 2-033552 2/1990

* cited by examiner

*Primary Examiner*—Stephen Gravini
(74) *Attorney, Agent, or Firm*—Proskauer Rose LLP

(57) ABSTRACT

A system and method for controlling flow in filtering systems and for balancing the flow through fluid systems employs flow control devices that minimize suspended matter precipitation. Several embodiments are included. In a first embodiment, a smooth-walled flow control device (410) with no abrupt transitions is provided in a flow conduit section. In a second embodiment, a filter (305) acts as a flow control device. A variation of the latter locates a flow control device (300) immediately adjacent to the filter (305) and upstream of it. In other embodiments, a control system (950) detects the real time status of the load to provide on the fly critical balancing.

39 Claims, 28 Drawing Sheets

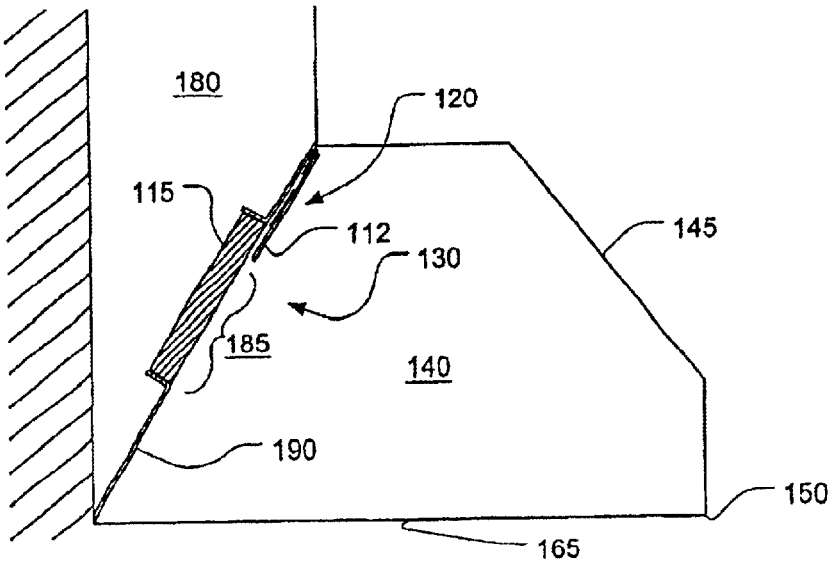
Fig. 5A
Fig. 5B
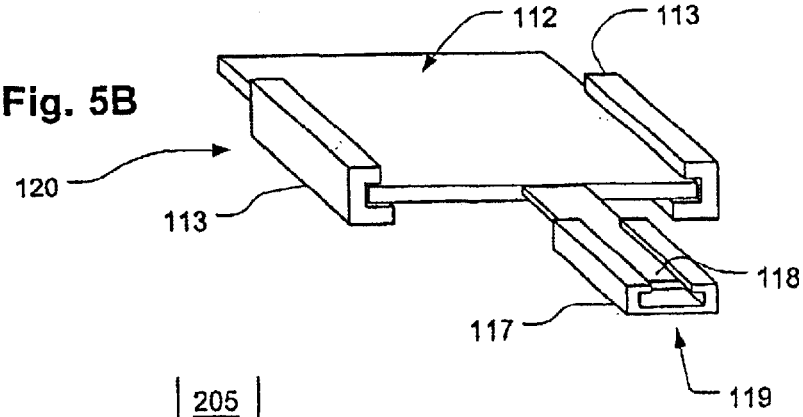
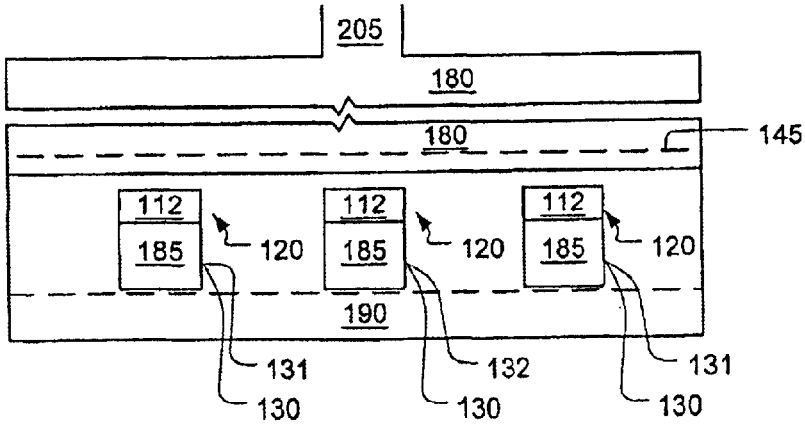
Fig. 6

DEVICE AND METHOD FOR CONTROLLING/BALANCING FLOW FLUID FLOW-VOLUME RATE IN FLOW CHANNELS

This application claims benefit of provisional No. 60/224,123 filed Aug. 10, 2000, Ser. No. 60/226,953 filed Aug. 22, 2000 and Ser. No. 60/263,557 filed Jan. 23, 2001.

FIELD OF THE INVENTION

The present invention relates generally to flow-volume control devices. More specifically, the present invention relates to flow control devices that may be used for balancing fluid flow in a context where suspended particles are entrained in the fluid and their precipitation must be avoided, in free-flowing parts of a flow system, except during filtration.

BACKGROUND

Exhaust hoods are used to remove air contaminants close to the source of generation located in a conditioned space. For example, one type of exhaust hoods, kitchen range hoods, creates suction zones directly above ranges, fryers, or other sources of air contamination. Exhaust hoods tend to waste energy because they must draw some air out of a conditioned space in order to insure that all the contaminants are removed. As a result, a perennial problem with exhaust hoods is minimizing the amount of conditioned air required to achieve total capture and containment of the contaminant stream.

Referring to FIG. 1, a typical prior art exhaust hood 90 is located over a range 15. The exhaust hood 90 has a recess 55 with at least one vent 65 (covered by a filter 60) and an exhaust duct 30 leading to an exhaust system (not shown) that draws off contaminated air 45. The vent 65 is an opening in a barrier 35 defining a plenum 37 and a wall of the canopy recess 55. The exhaust system usually consists of external ductwork and one or more fans that pull air and contaminants out of a building and discharge them to a treatment facility or into the atmosphere. The recess 55 of the exhaust hood 90 plays an important role in capturing the contaminant because heat, as well as particulate and vapor contamination, are usually produced by the contaminant-producing processes. The heat causes its own thermal convection-driven flow or plume 10 which must be captured by the hood within its recess 55 while the contaminant is steadily drawn out of the hood. The recess creates a buffer zone to help insure that transient, or fluctuating, surges in the convection plume do not escape the steady exhaust flow through the vent. The convection-driven flow or plume 10 may form a vortical flow pattern 20 due to its momentum and confinement in the hood recess. The Coanda effect causes the thermal plume 10 to cling to the back wall. The exhaust rate in all practical applications is such that room air 5 is drawn off along with the contaminants.

Referring now also to FIG. 2, exhaust hoods 90, such as illustrated in FIG. 1, vary in length and can be manufactured to be very long as illustrated in FIG. 2. Here multiple vents 65 can be seen from a straight-on view from the vantage of a worker 80. The length can present a problem because the perimeter along which capture and containment must be achieved is longer near the ends than in the middle. In the middle, there is only one perimeter, the one along the forward edge indicated at 70 in FIG. 1. At the ends, this perimeter includes the side edge as well which is indicated at 75 in FIG. 1. The additional perimeter length that must be accommodated at the ends may be called an "end effect." In other words, the hood cannot be approximated as a two-dimensional configuration because of its finite length. As a result of the increased perimeter at the ends, more air must be exhausted in the vicinity of the ends of the hood than in the middle because the perimeter at the ends consists of both the forward edge 70 of the hood adjacent the worker and end edges 75, which are perpendicular to the forward edge 70.

If the minimum exhaust rate for the entire hood is to be achieved, then less air should be exhausted near the middle section than near the ends. Otherwise, an excess rate of air exhaust will occur near the middle section to insure the rate at the ends is sufficient. Thus, as a result of the end effects and the requirement of full capture and containment, more air must be drawn through the middle section than necessary. In addition, a higher volume of effluent may be generated at some parts of a hood than at others. This variability leads to the same result: some parts of the hood may require a greater exhaust rate than others.

Referring to FIG. 3, a similar problem occurs when multiple hoods are connected to a single exhaust system. For example, the hoods may be connected to a common exhaust duct 191. Each hood must be balanced against the others so that each exhausts at the minimum rate that ensures full capture and containment of the contaminants. Again, ducts carrying grease aerosol should not have dampers because of the hazard caused by grease precipitation.

It is known in the prior art to make fixed modifications to the flow requirements of a long hood to address the end effects.

SUMMARY OF THE INVENTION

Briefly, flow control devices located either within a duct or inside a hood recess enable the control of the relative exhaust volume flow rates through sections of a long exhaust hood or through separate hoods linked to a single exhaust fan. In one embodiment, flow control devices are located inside the ducts. Although using flow control devices in a duct is known, conventional flow control devices, known as "dampers," cause aerosol precipitation in exhaust ducts of kitchen ventilation systems and are therefore not used. To address this problem, the latter flow control devices are shaped to minimize steady and quasi-steady flow effects associated with the precipitation of grease from the aerosol state. In another embodiment, the flow control devices are located within the hood recess so that any precipitation that occurs as a result of the steady flow structures will remain within the recess and can be cleaned easily. Both types of flow control devices must be designed differently from conventional dampers. Flow control devices within the ducts are designed to restrict flow without forming flow effects that result in the precipitation of grease. Flow control devices within the canopy recess are designed such that they do not interfere with the vortical flow effect caused by the thermal convection plume. Each device may be adjustable or fixed, but preferably they are adjustable in applications where perfectly uniform negative pressures in the building exhaust hookups cannot be guaranteed.

A first type of flow control device provides a smooth transition or transitions that do not create regular (stationary or periodic) flow effects associated with precipitation of grease. These are located in the exhaust duct. Flow-volume control dampers with smooth flexible walls are described in detail in U.S. patent application Ser. No. 60/226,953, filed on Aug. 22, 2000 entitled FLOW-VOLUME CONTROL DEVICE, which is hereby incorporated by reference in its entirety as if fully set forth herein. A second type is located in the hood recess and is designed not to intrude into the recess in such a way as to interfere with the vortical flow therein. One category of the second type are dual-function grease filters that control the flow rate and perform the grease-separation function simultaneously.

Another strategy for throttling flow without introducing a separate cause of grease (or other suspended particulate) is to make a filter, often present in such systems, that functions as a flow throttling device itself. This may be done in various ways by modulating the size of apertures that are integral with the filter cartridge without interfering with the cartridge's ability to filter out particulates.

According to still other embodiments, the invention provides a control system to provide real time control of the balancing devices. To that end, various sensor inputs may be employed to determine when a hood is as close as possible to a minimum flow rate and prior to a breach. Infrared camera imaging, temperature sensors, and other detection devices may be used to classify the real time status of the load and to control the balance accordingly.

While the invention will now be described in connection with certain preferred embodiments and examples and in reference to the appended figures, the described embodiments are not intended to limit the invention to these particular embodiments. On the contrary, it is intended to cover all alternatives, modifications, and equivalents as may be included within the scope of the invention as defined by the appended claims. Thus, the following description and examples of the preferred embodiments of the invention are only intended to illustrate the practice of the present invention. The particular embodiments are shown by way of example and for purposes of illustrative discussion of the preferred embodiments of the present invention. While the embodiments are described in relation to a metal-air battery cell, the invention is not limited solely to this type of battery cell. Parts of the invention can also be applied to alkaline and other primary battery cells. Prism-shaped metal-air battery cells are illustrated in the description of the invention because the metal-air battery cells are particularly suitable for describing many of the features of the invention. While the embodiments are described in relation to a rectangular shaped battery cell, the invention is not limited to battery cells having rectangular casings. Instead, the invention covers all prism-shaped battery cells, including but not limited to hexagonal, octagonal, and other cells having casings with relatively straight side walls.

The particular embodiments are presented in the cause of providing what is believed to be the most useful and readily understood description of the principles and conceptual aspects of the invention. In this regard, no attempt is made to show structural details of the invention in more detail than is necessary for a fundamental understanding of the invention. The description, taken with the drawings, makes it apparent to those skilled in the art how the several forms of the invention may be embodied in practice.

BRIEF DESCRIPTION OF THE FIGURES

FIG. 5A. is a section view of a canopy style hood according to the embodiment of FIG. 4.

FIG. 5B. is a perspective view of a shutter with an actuator mechanism according to embodiment of the invention.

FIG. 6 is a front view of a canopy style hood with multiple vents including the shutter mechanism of FIG. 5B.

FIG. 22B is a section view of the filter of FIG. 22A in a throttle-down position.

DETAILED DESCRIPTION OF THE EMBODIMENTS

Figure 4:
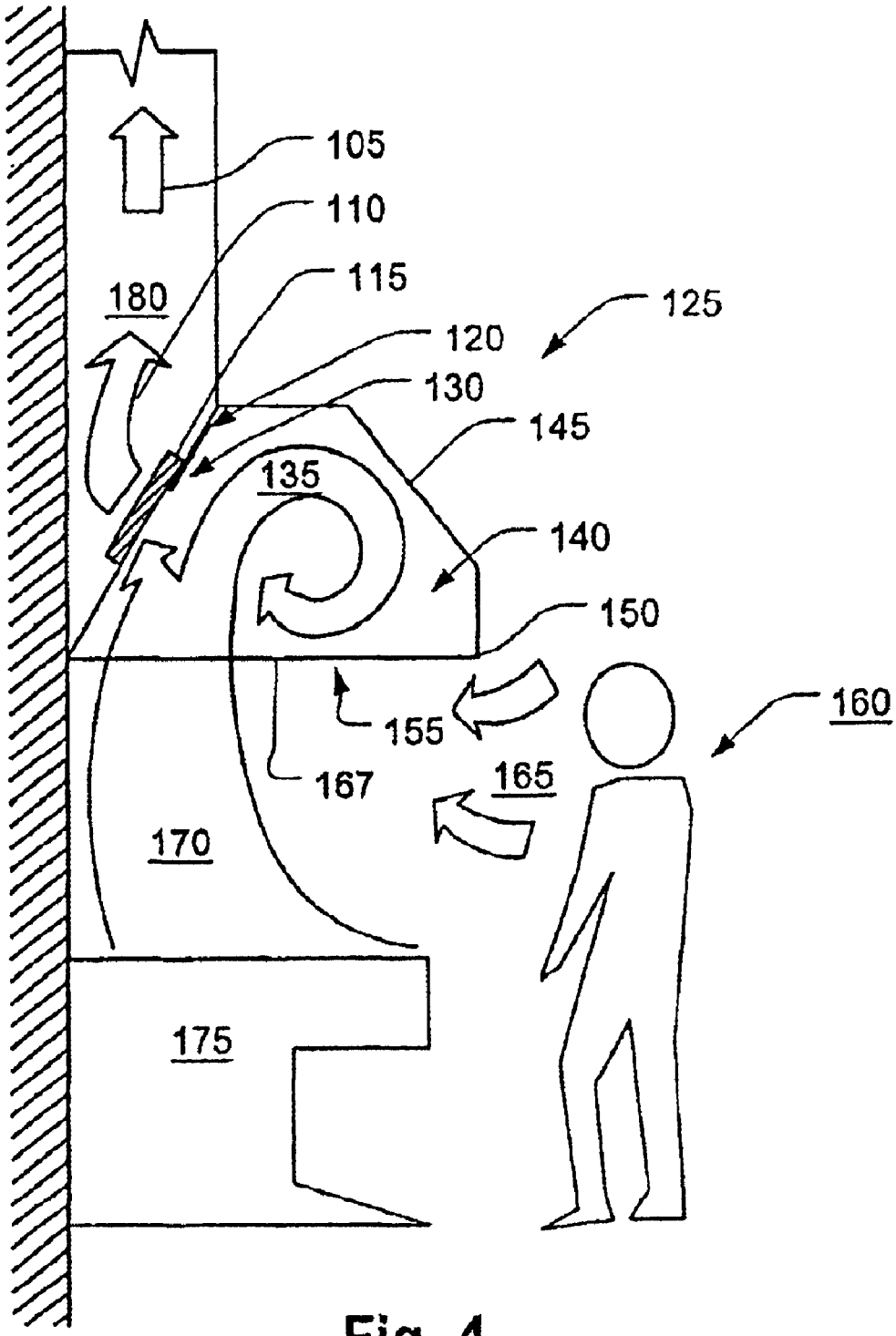
FIG. 4 is a side section view of a canopy style hood according to embodiment of the invention.

Referring to FIG. 4, a kitchen hood 125 has a canopy 145 positioned over a heat/contaminant source 175 (such as a grill) to capture a thermal convection plume 170 produced by the heat/contaminant source 175. The canopy 145 defines a recess 140, having an access 155. An exhaust fan (not shown) draws a flue stream 105 through an exhaust plenum 180. Negative pressure in the exhaust duct 180 in turn draws gases residing in the recess 140 through a vent 130. In the vent 130 is a mechanical grease filter 115, set in a boundary wall 120 that defines part of the recess 140. The filter reduces the mass of suspended grease particles in the resulting flue stream. The grease filter 115 may be an impingement filter or one based on cyclone type separation principles. The thermal convection plume 170 carries pollutants and air upwardly into the canopy recess 140 by buoyancy forces combined with forced convection resulting from the suction created by the exhaust fan. A combined effluent stream comprising the thermal convection plume 170 and conditioned air drawn from the space 165 in which the hood 125 is located, flows into the vortex 135. This flow is extracted from the canopy recess 140 steadily forming the effluent stream 110, which becomes the flue stream 105.

Figure 1:
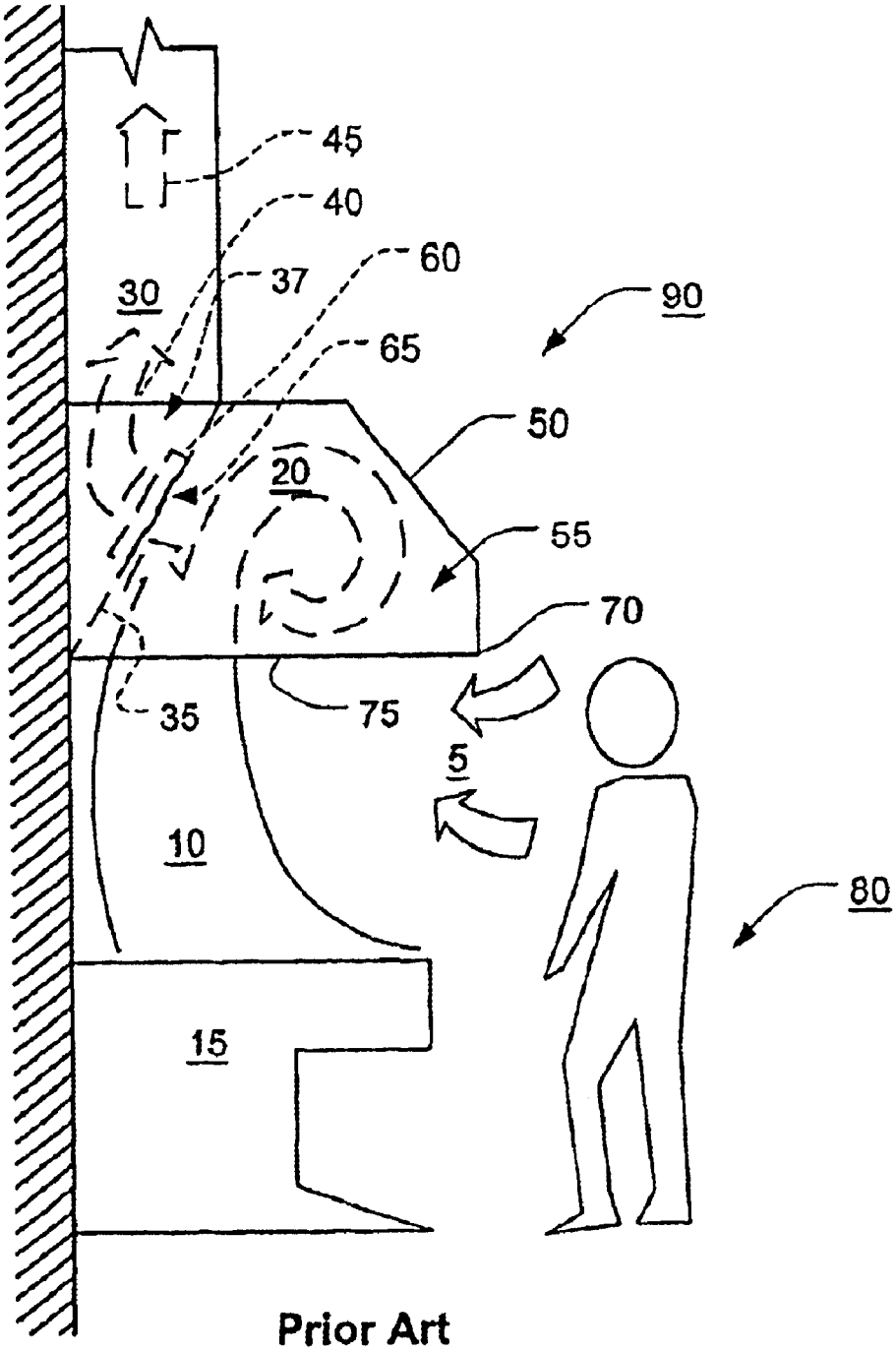
FIG. 1 is a side view of a canopy style wall hood according to the prior art.
Figure 2:
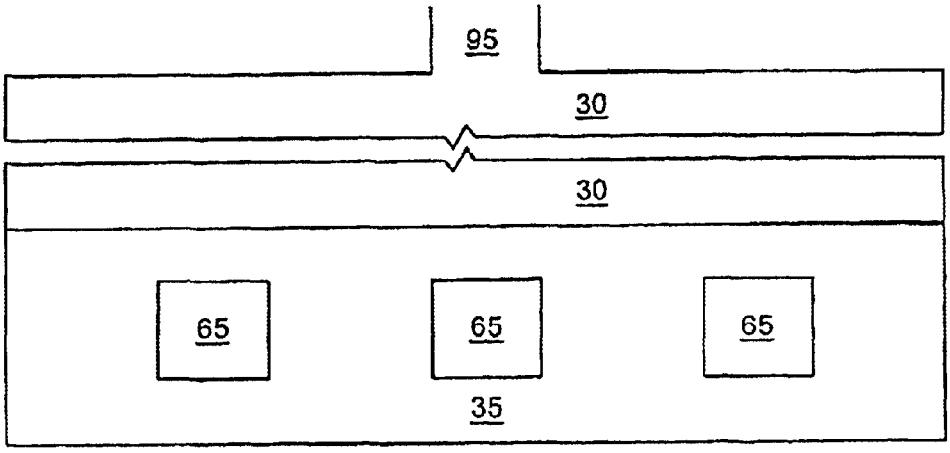
Prior Art Fig. 2
FIG. 2 is a front view of a long canopy style hood with multiple vents.
Figure 3:
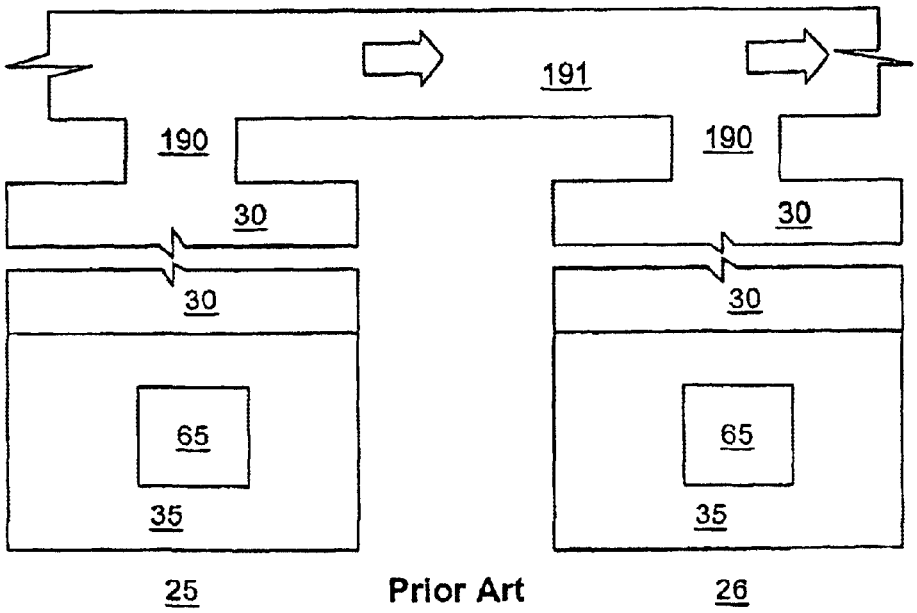
Prior Art Fig. 3
FIG. 3 is a front view of multiple hoods attached to a common exhaust system.

The kitchen hood 125 may have multiple vents 130, each connected to the exhaust plenum 180. Alternatively, multiple exhaust plenums 180 may be connected to a single exhaust duct header (not shown but as indicated at 191 in FIG. 3) supplied by a single fan (not shown) as will be appreciated by those skilled in the relevant art. The exhaust rate through the exhaust plenum 180 or exhaust duct header determines the rate of extraction of effluent and indoor air 165 by the hood 125. The determination of the optimal flow rate involves a tradeoff between energy conservation and a requirement called capture and containment. Capture and containment is the state where no pollutant from the thermal plume 170 or the buffered volume in vortex 135 escapes into the conditional space.

Full capture and containment requires the exhaust of at least some air 165 from the space in which the hood 125 is located. To conserve energy, the exhaust rate should be set at the lowest possible rate that still provides full capture and containment. This setting must account for the variability of the thermal plume 170, which varies with the cooking load, stage of cooking (e.g., rendering of fat which causes dripping and attendant smoke), and random variation (e.g., random dripping from fatty foods) or steam generation. Thus, not only does the exhaust load vary along the canopy 125 (in the direction into the plane of the drawing), as discussed in the background section, it also varies with time. The prior art approach has been one of setting the flow rate according to the peak expected load. This approach insures that the bulk exhaust rate is high enough to provide full capture and containment by the hood, or hood portion, requiring the greatest volume of exhaust to achieve it (capture and containment), at the times of maximum instantaneous load.

Again, the load can vary along the length of a long hood or from hood to hood and the balancing problem is analogous in balancing from hood portion to hood portion as it is for balancing from hood to hood.

In the present system, a flow control system is employed to permit modulation of the exhaust from one hood 125 to another or from one vent 120 to another along a single long hood 110. In addition, the potential exists to provide this flow control system, to be discussed hereon, with real-time control. Thus, according to the inventive system, the exhaust rate may be controlled to achieve the lowest local ("local" referring generically to the respective hood portion or the respective each hood linked to a common exhaust) exhaust rate required for the current local, instantaneous load. This is achieved by controlling the local exhaust rate by an active flow control device 120 linked to a real-time control (discussed in greater detail much later in the present specification).

Figure 7:
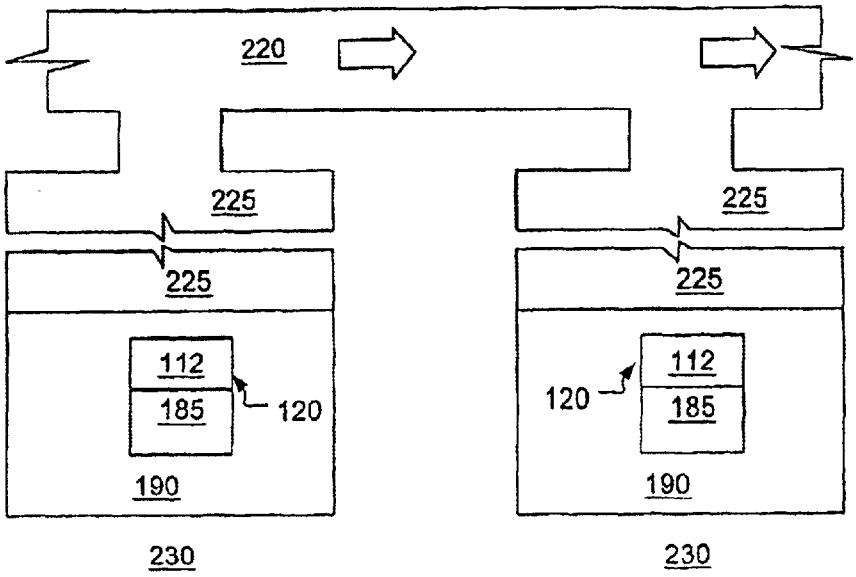
FIG. 7 is a front view of multiple canopy style hoods connected to a common exhaust in which respective vents of the hoods are controlled by shutter mechanisms according to embodiment of the invention.

Referring now also to FIGS. 5A, 5B, and 6, to balance flow across a single hood 145 (FIG. 6), or across multiple hoods connected to a single exhaust system (see FIG. 7), a flow control device 120 selectively blocks a portion of an exhaust vent 130 in a boundary wall 190 of the hood 145. The flow control device 120 has a flat plate 112 partially covering the vent 130 defining an aperture 185. The flat plate 112 is selectively moved across the vent 130 which makes the aperture 185 variable-sized. The flat plate 112 may be moved by a linear actuator 119 such as a linear motor with a driver 118 and stator 117. The flat plate 112 may be guided by linear bearings 113. Note that the shape of the flow control device 120 is generally flat so that its impact on the shape of the canopy recess 140 is minimal. Thus, the flow control device 120 does not interfere with the vortical flow pattern 135. Where canopy 145 is of great length (again, "length" referring to the dimension perpendicular to the plane of the FIG. 5A drawing and best illustrated by FIG. 6), where multiple vents 130 are linked to a common exhaust duct 205, the respective flow control devices 120 may be set to provide a larger aperture 185 for the vents 130 close to the ends of the canopy 145 and to provide a smaller aperture 185 for the vents 130 near the middle of the canopy 145. Alternatively, if the type of cooking appliance or load varies along the length of the hood, the flow control devices 120 may be set accordingly. Referring now also to FIG. 7, in multiple hoods 230 linked to a common exhaust header 220 the flow control device 120 may be set to restrict flow more in those canopies 145 protecting lower loads and to restrict flow less in canopies 145 protecting higher loads. Further, real-time control, which is discussed later in the present specification, may be used to control each flow control device 120 according to an instantaneous load sensed by a smoke, temperature, image, and/or other sensor system as described below.

Figure 8:
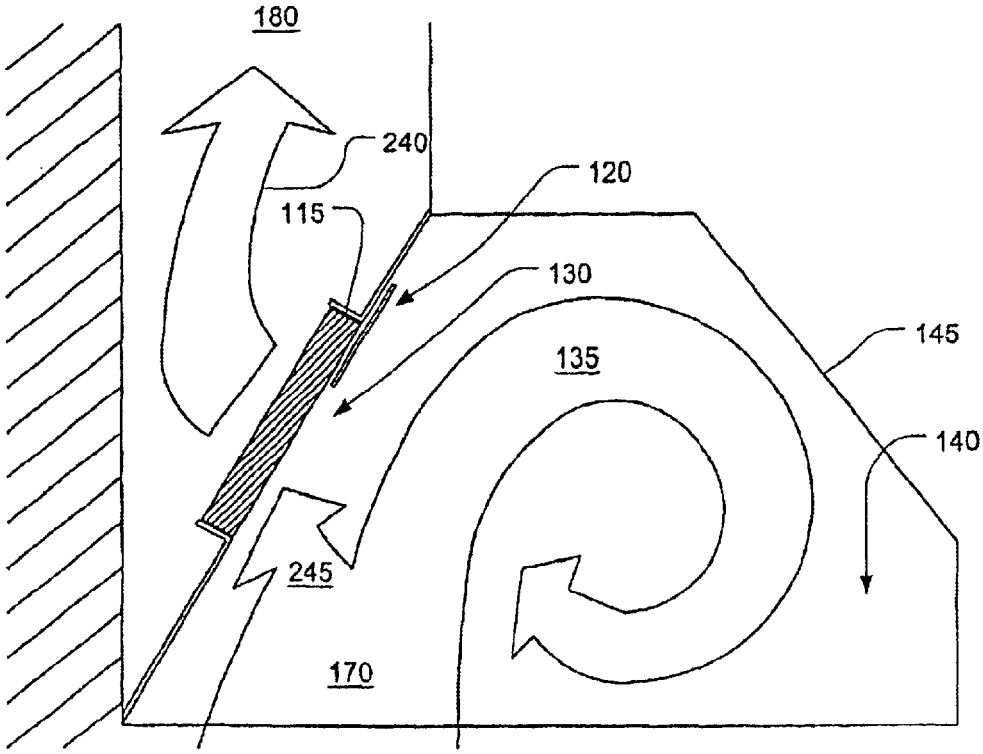
FIG. 8 is a section view of a canopy hood with a shutter according to another embodiment of the invention.

Referring to FIG. 8, the canopy recess 140 acts as a buffer to dampen the effects of temporal variability in the load. The thermal plume 170 rises at a rate that is faster than the mean rate of exhaust. In wall-type hoods as illustrated, the flow 135 circulates within the canopy recess 140 dissipating its energy in a turbulent cascade whilst the plume 170 and room air 165, drawn by negative pressure created by the exhaust fan (not shown), are tapped from the canopy recess 140 as indicated figuratively by the arrow 245. The shape of the canopy recess 140 augments the vortical pattern by guiding it in a circular path as illustrated at 135. The vortical pattern may not be present in all hoods, but all hoods have some capacity to buffer temporal variability in the load whether a stable vortex is formed or not. More complex flow patterns may arise in other hoods, depending on the load, the hood shape and other variables.

Figure 9A:
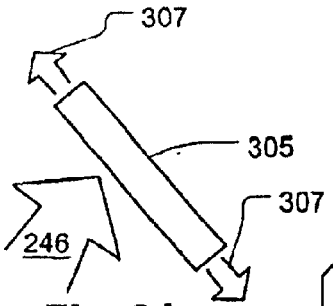
FIG. 9A is a side view of a centrifugal style cartridge filter used for grease extraction.
Figure 9B:
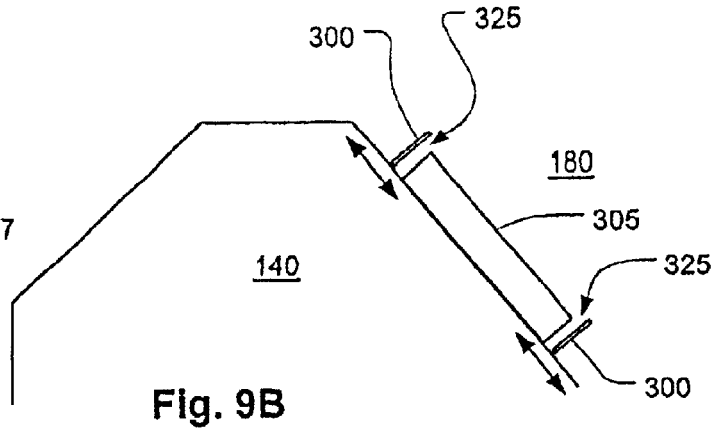
FIG. 9B. is a section view of a canopy style hood with a flow control mechanism according to another embodiment of the invention.
Figure 10:
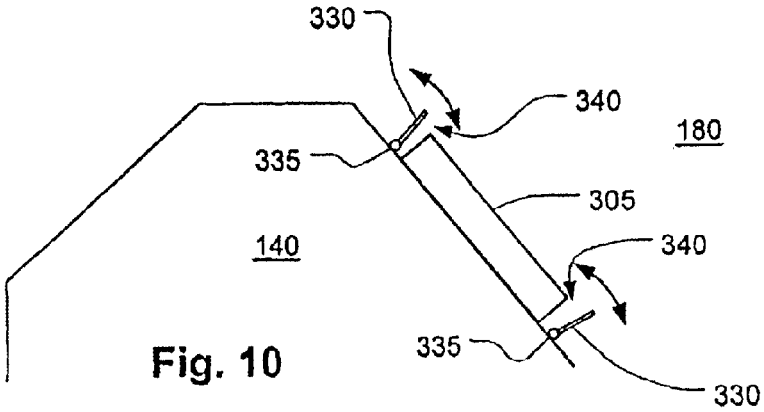
FIG. 10 is a side view of a canopy style hood with the flow °control mechanism according to still another embodiment of the invention.

Referring now to FIGS. 9A, 9B, and 10, another type of flow control device provides variable control of the flow rate through certain types of filters 305. Referring momentarily to FIG. 9A in particular, in certain types of filters 305, the raw effluent stream enters as indicated at 246 and leaves at the ends of the filters as indicated at 307. Examples of this type of filter are described in U.S. Pat. No. 4,872,892, which is hereby incorporated by reference in its entirety as if fully set forth herein. Focussing again on FIG. 9B, the exit flows 307 are selectively blocked by movable plates 300 thereby providing a variable exit passage 325. In the embodiment of 9B, the plates 300 translate as indicated by arrows 308. In the embodiment of FIG. 10, movable plates 330 are pivotably mounted by hinges 335 and pivoted to provide variable exit passages 340.

Figure 11:
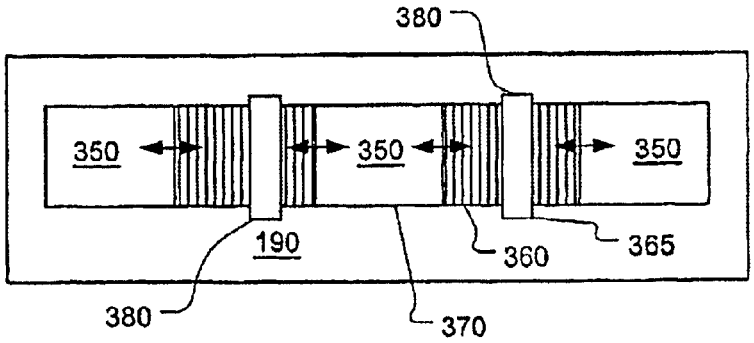
FIG. 11 is a front view of vents of a canopy hood or back shelf hood with rolling shutters according to yet another embodiment of the invention.
Figure 12:
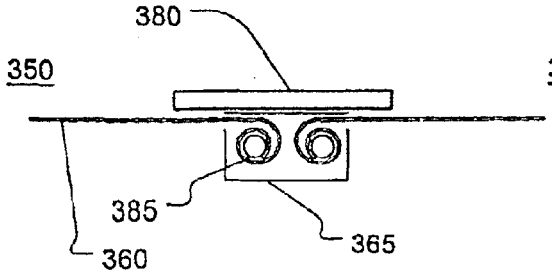
FIG. 12 is a section view of rolling shutter mechanism according to an embodiment of the invention.

Referring now to FIGS. 11 and 12, another embodiment of a flow control device employs scroll shutters 360 that unroll from spools 385 inside a covered compartment 265. Each shutter 360 selectively blocks a vent 370 on the canopy recess side thereby providing a variable aperture 350 respective of each vent 370. Each vent 370 may be separated by a partition portion 380 from one or two adjacent vents 370. Suitable guides and drive mechanisms are available from the field of movable shutters and may be employed to actuate the present embodiment.

Figure 13:
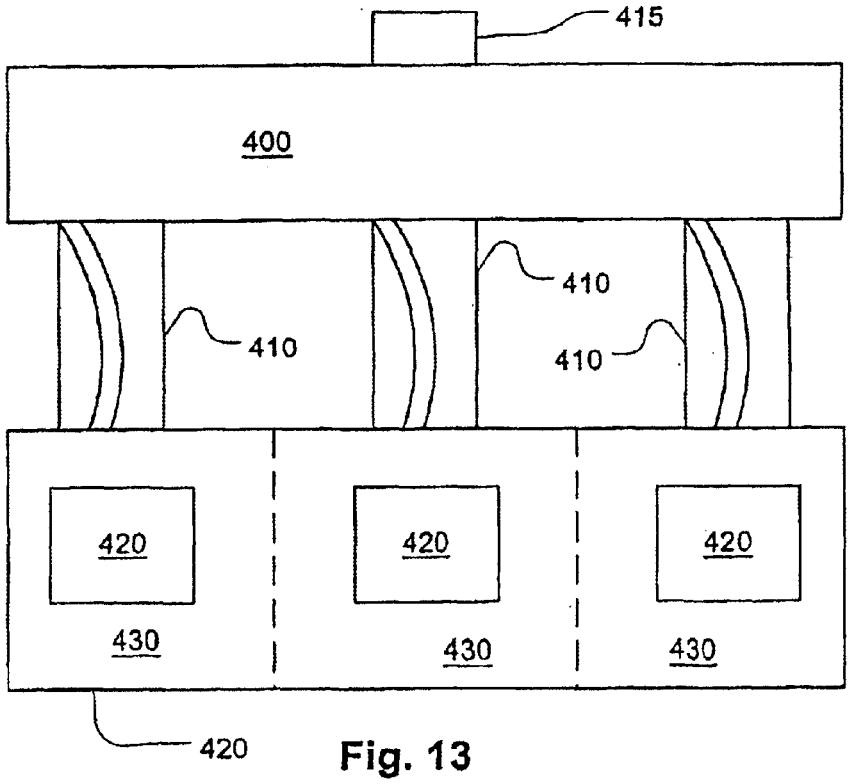
FIG. 13 is a partial section view all long hood with multiple exhaust vents and corresponding flow of throttling devices according to an embodiment of the invention.
Figure 14:
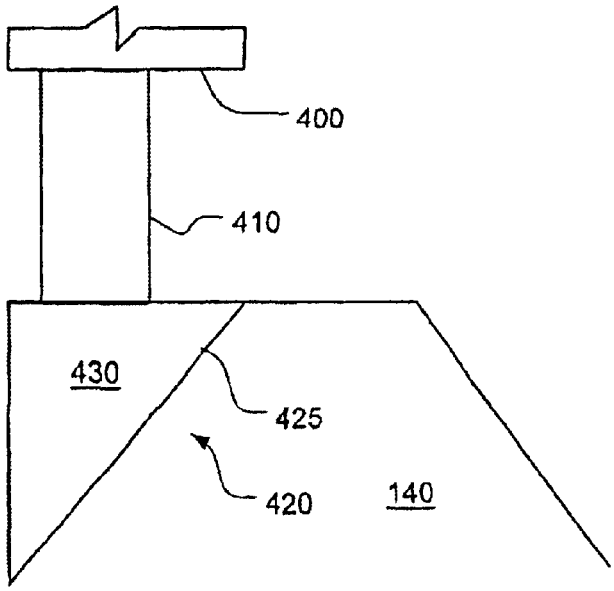
FIG. 14 is a sectional side view of the embodiment of FIG. 13.

Referring to FIGS. 13 and 14, a flow control device such as described in U.S. patent application 60/226,953 may be employed in a duct leading from the respective vents 420 of a single hood or from groups of vents in one or more hoods all linked to a common exhaust (not shown in this drawing). In the embodiment of FIGS. 13 and 14, a single hood is shown. A wall 425 of the recess has three vents 420 each leading to a respective plenum 430. Each plenum is connected to a duct containing a flow control device 410 having smooth walls as described in the above US Patent Application. Each flow control device 410 then leads to a common plenum 400 from which effluent is drawn through a common exhaust 415. By regulating each flow control device 410 separately, the flow through the respective vents 420 can be optimized as discussed above. A similar configuration may be used to balance respective hoods connected to a common exhaust.

Figure 15:
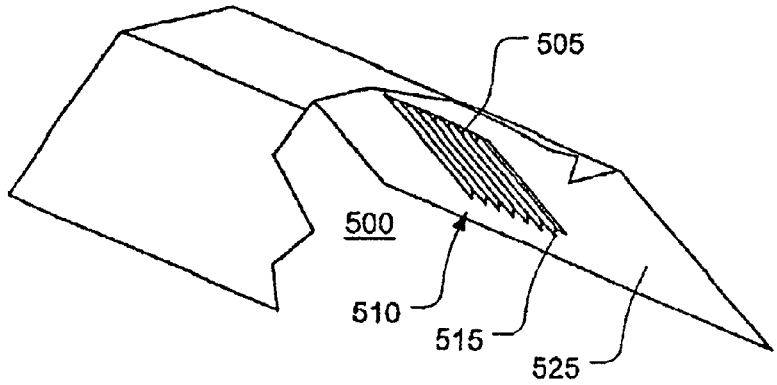
FIG. 15 is the perspective cut away of a shutter mechanism according to embodiment of the invention.
Figure 16:
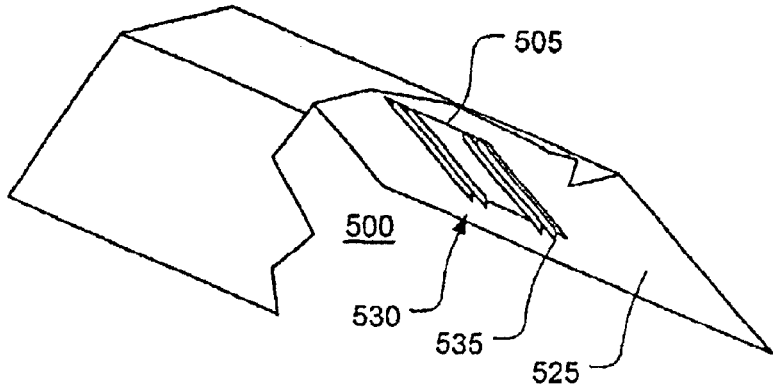
FIG. 16 a perspective cut away of a shutter mechanism according to another embodiment of the invention.

Referring to FIG. 15, another type of flow control device 510 selectively blocks flow through a vent 505 (in a wall of a canopy 525) using a vertical-blind type mechanism. Louvers 515 of the flow control device 510 pivot in a manner analogous to window blinds. The louvers 515 may be oriented with their pivot axes parallel to the tangent of the vortex 135 formed within a canopy recess 500. In this orientation, the louvers 515 generate less resistance to the vortical flow. To vary the flow through the flow control device 510, the louvers 515 are pivoted about their axes in concert to vary the net flow area through the vent 505 in the canopy wall 525. Referring to FIG. 16, in flow control device 530, which is similar to that of FIG. 15, louvers 535 are located over only a portion of the vent 505, since the flow may not need to be cut off 100%. Alternatively, the louvers 515 may be as in FIG. 15, but not close 100%.

Figure 17:
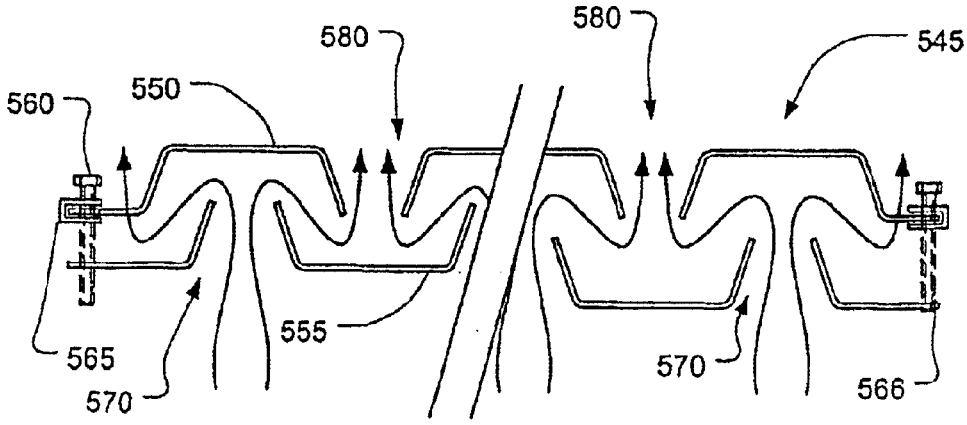
FIG. 17 is a sectional view of a combination filter/flow throttling device according to embodiment of the invention.

Referring to FIG. 17, the structure of an impingement filter 545 is varied to modulate flow therethrough. The drawing shows a split view of a single filter in two configurations. On the left side of the drawing, the concave-back plates 550 and concave forward plates 555 are close together narrowing the flow passage between the inlets 570 and the outlets 580. In the right side of the drawing, the separation distance is increase providing a larger flow passage that is correspondingly less resistant to flow therethrough. The separation distance may be varied progressively or stepwise, depending on design choice, by any suitable mechanism.

In the example shown, adjustable standoffs 560 are used to separate the plates 550 and 555. For example, the adjustable standoffs could be screws 560 with idle clips 565 that hold one end of the screws 560 at a fixed position along it length and threaded holes 566 that traverse the lengths of the screws 560 when it is turned. The separation device may be automatic or manual, as required.

Figure 18:
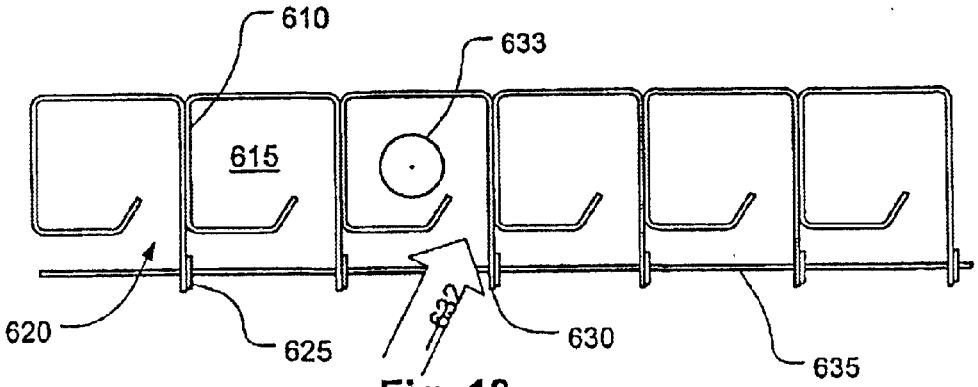
FIG. 18 is a sectional view of a combination filter/flow throttling device according to embodiment of the invention.
Figure 19:
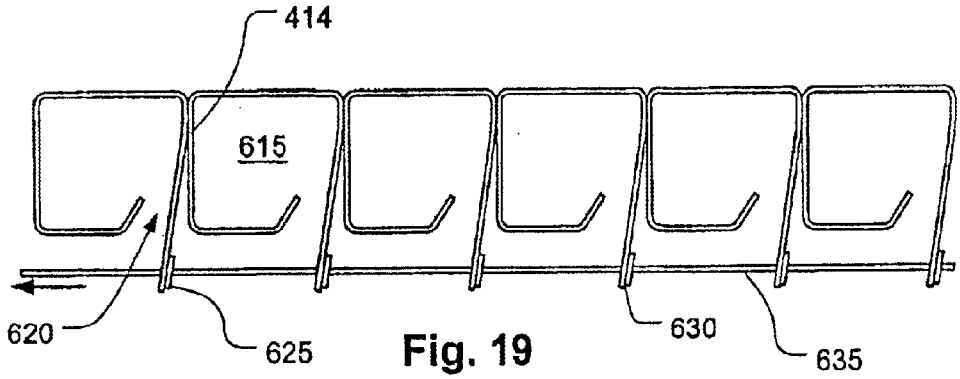
FIG. 19 is a sectional view of a combination filter/flow throttling device of FIG. 18 in a throttle-down position.
Figure 20:
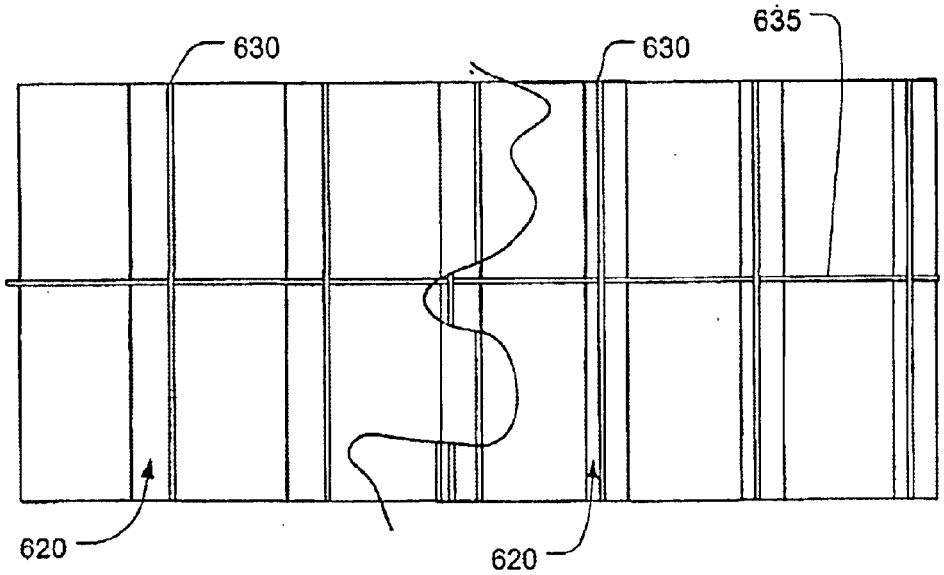
FIG. 20 is the face view of the filter of FIGS. 18 and 19 shown partly in throttle-down position and partly in throttle-up position.

Referring to FIGS. 18, 19, and 20, in a configuration of a grease filter of a type similar to those described in U.S. Pat. No. 4,872,892, modulation of the flow of exhaust through a vent of a range hood is afforded. In this embodiment, a filter is formed substantially as described in the above patent. That is, air flows into slots 620 along a face of the filter as indicated at 632 (all similar slots—only one is labeled) and exits through the ends of tubular sections 610 as indicated by the outward-facing-flow symbol 633. While travelling through each chamber tubular section 615, the flow swirls helically due to the tangential entry of the flow at each slot 620. The aperture of the slots 620 is varied by bending a flexible wall 630 of each slot by a gang pull-rod 635. When the gang pull-rod is moved as illustrated in FIG. 19, the flexible walls 630 bend narrowing the slots 620 and restricting the flow. FIG. 20 is a split view showing two configurations of the filter. The open configuration of FIG. 18 is illustrated on the left side of FIG. 20 and the closed configuration of FIG. 19 is illustrated on the right side of FIG. 20. The aperture 620 may be varied progressively or in steps.

Note that while in the embodiment of FIGS. 18–20, the inlet slots 620 are varied in flow area by bending a wall that forms the tubular chambers 615, it is possible to accomplish a similar result using separate blocking plate with a hinge. That is, the wall 630 may be a separate element pivotably attached to the rest of the modules 610.

Figure 21A:
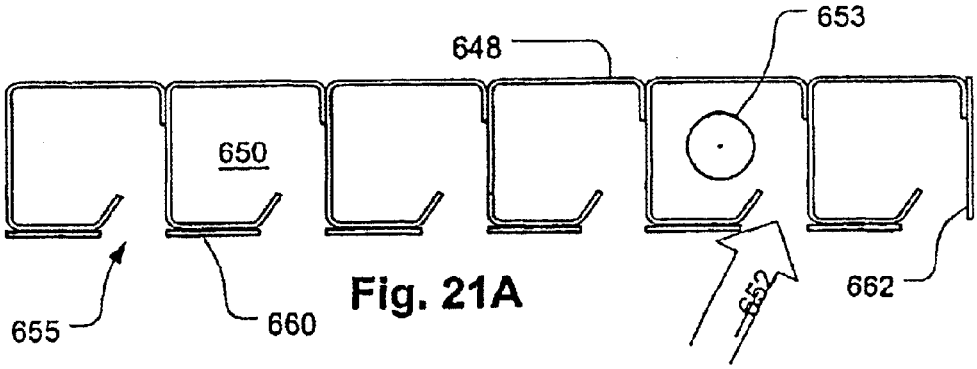
FIG. 21A is a sectional view of a combination filter/flow throttling device according to yet another embodiment of the invention.
Figure 21B:
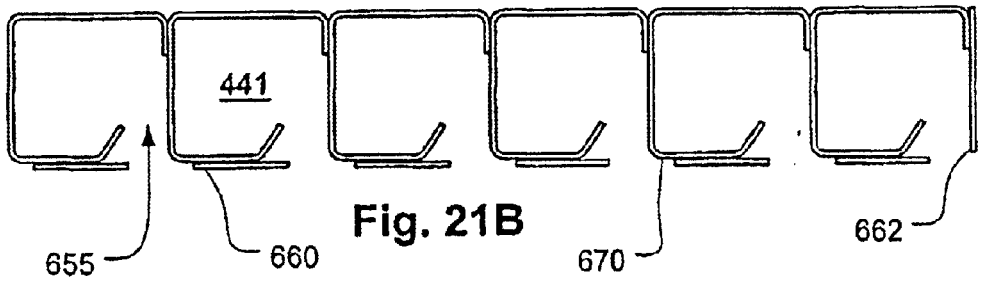
FIG. 21B. is a sectional view of the filter/flow throttling device of FIG. 21 a in the throttle-up position.
Figure 21C:
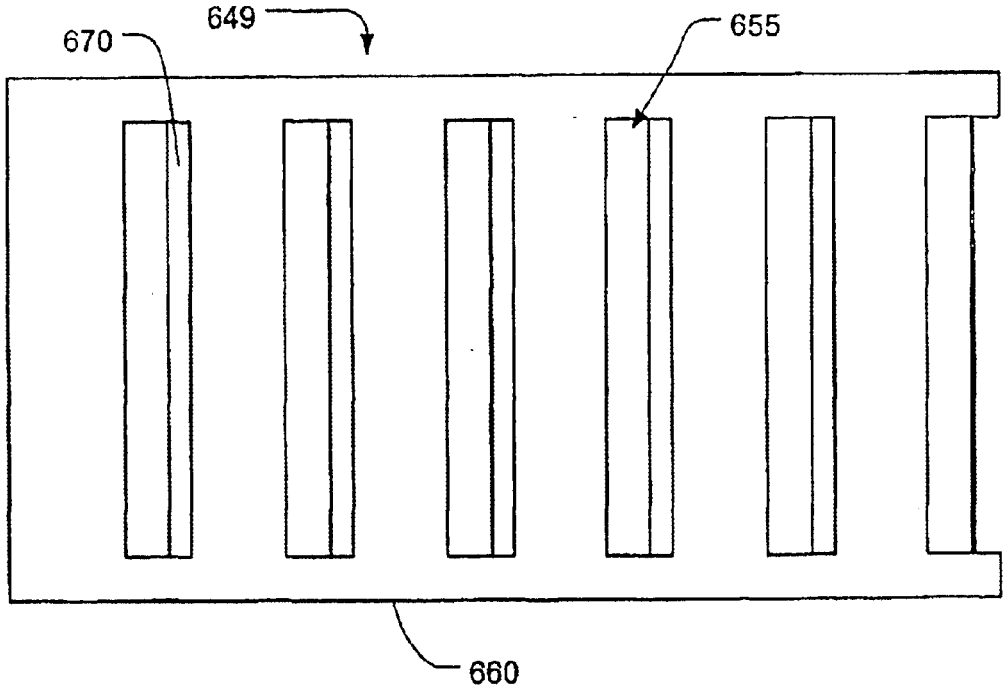
FIG. 21C. is a front view of the filter of FIGS. 21*a* and 21B.

Referring to FIGS. 21A, 21B, and 21C, based on a filter design similar to those of U.S. Pat. No. 4,872,892, flow entering the filter is selectively blocked by a movable shutter plate 660. Again each tubular chamber 650 receives air through a respective slot-shaped flow aperture 655 and delivers it through exits 649 of each of a plurality of modules 648 as indicated by the arrows 656 and 657. When the shutter plate 660 is in a relatively open position as shown in FIG. 21A, each flow aperture 655 is relatively large in area. When the shutter plate 660 is in a relatively closed position as shown in FIG. 21B, the flow aperture 655 is relatively small in area. Thus, the shutter plate 660 position may be used to control the pressure drop across the filter and consequently the flow rate across the filter.

All of the filters that are able to control flow may be used for hood balancing. If each filter is controlled independently, the flow rate through each vent of one or more hoods can be controlled independently. Each filter may be controlled in each hood of a system to flow-balance longer hoods and to balance hoods against each other. Alternatively, a single filter of a hood with multiple vents can be controlled leaving the other filters uncontrolled. This may allow the balancing of the entire hood against other hoods. In a longer hood, this solution may be less desirable because it would vary the exhaust rate across the length of the hood, which may produce inefficiencies as discussed above.

Figure 22A:
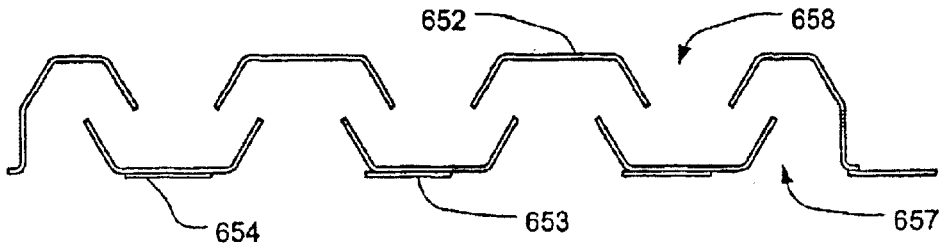
FIG. 22A is a section view of a filter/flow throttling device according to another embodiment of the invention.
Figure 22B:
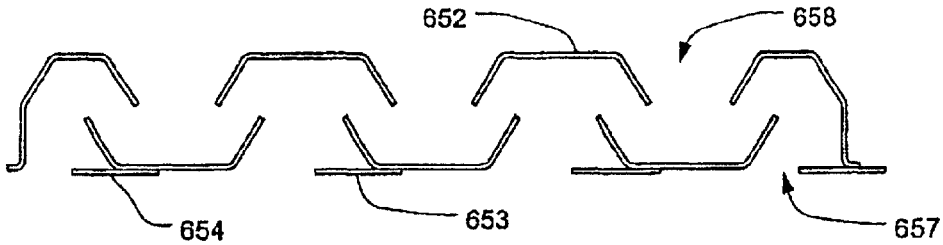
FIG. 22B.
Figure 22C:
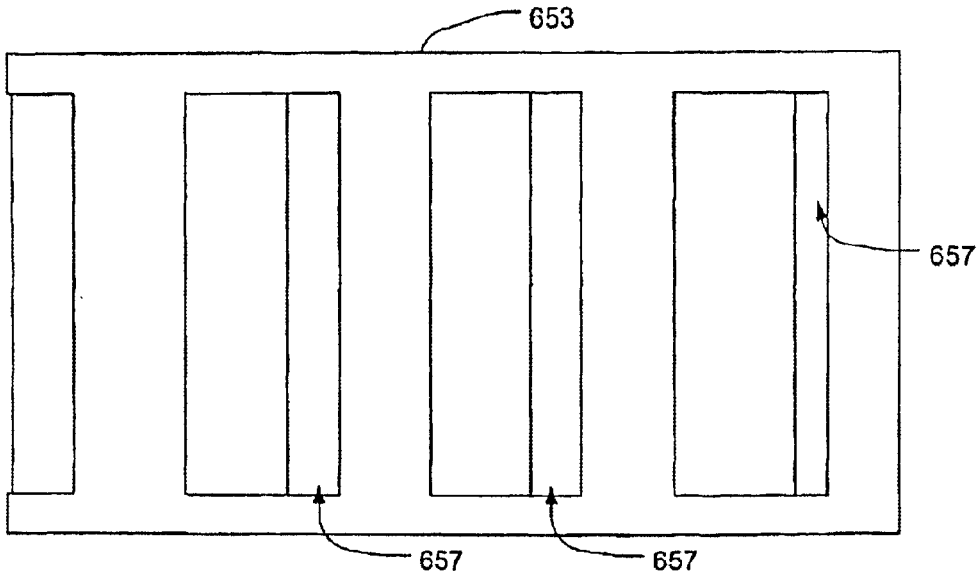
FIG. 22C is a front view of the filter of FIGS. 22A. and 22B.

Referring to FIGS. 22A, 22B, and 22C, based on a more conventional type of filter cartridge known as an impingement filter (also discussed above), a shutter plate 653 is moved to vary the size of flow apertures 657. Effluent flows from the inlet flow apertures 657 to respective outlets 658. The selective variation of the flow apertures 657 varies the pressure drop through the flow apertures 657. Note that although in this embodiment, a shutter plate 653 is used to selectively block the aperture 657, it is clearly possible to use a shutter plate to selectively block the outlets 658 or both to achieve the same effect.

Figure 23A:
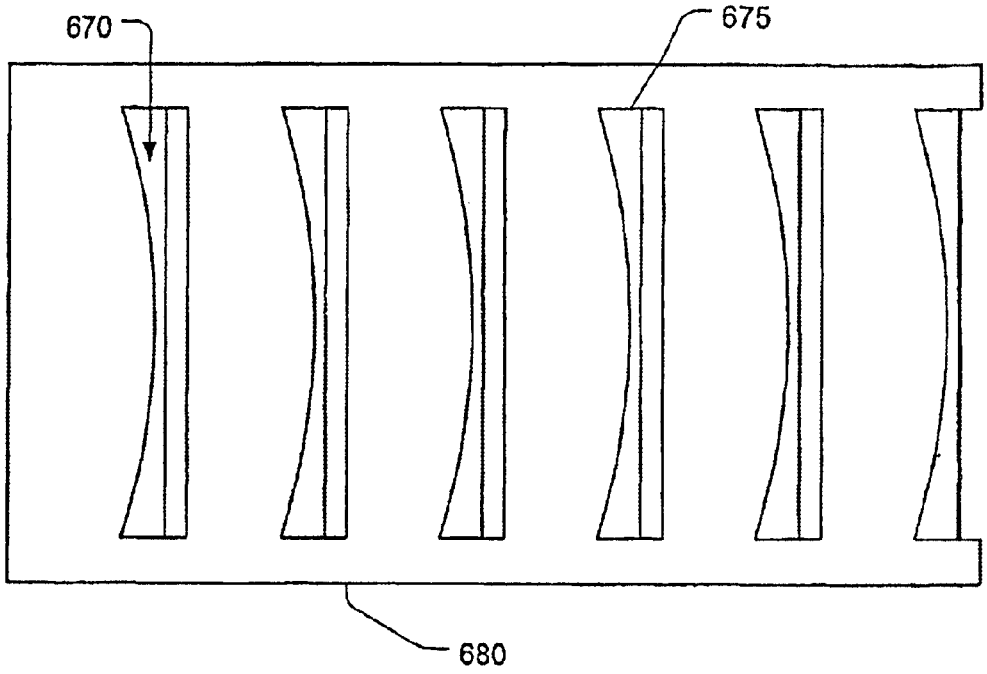
FIG. 23A is a alternative embodiment of the device of FIGS. 22A through c.
Figure 23B:
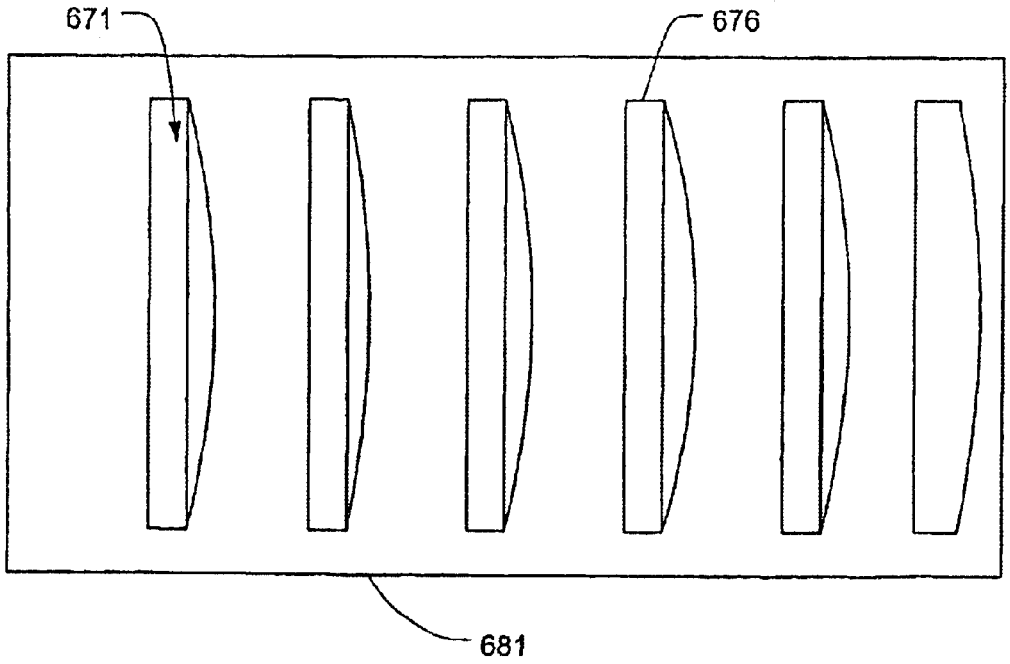
FIG. 23B. is an alternative embodiment of the device of FIGS. 22*a* through 22C.

The shutter plate of FIGS. 21A–C and 22A–C are illustrated as having rectangular openings. Referring to FIGS. 23A and 23B, it is possible to employ other shapes to good effect. For example, in the embodiment of FIG. 23A, a shutter plate 680 has openings 675 with a curved border such that access to the middle section of the filter is blocked more than the ends. In the embodiment of FIG. 23B, the opposite is true. In the latter embodiment, a shutter plate 681 has openings 676 with a curved border such that access to the end sections is blocked more than the middle section. Either embodiment may be used with either type of filter cartridge or others not described herein, but the embodiment of FIG. 23B may be more favorable in a filter such as described in U.S. Pat. No. 4,872,892 because it favors a longer travel path of the air along the flow modules providing greater grease separation in the process.

Figure 24A:
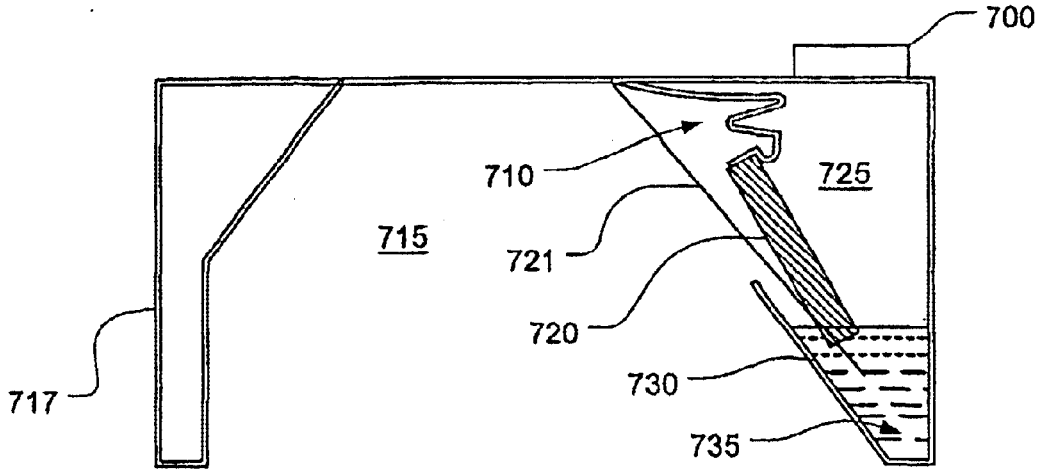
FIG. 24A. is a section view of a canopy hood with a flow throttling device including a cleaning fluid according to embodiment of the invention.
Figure 24B:
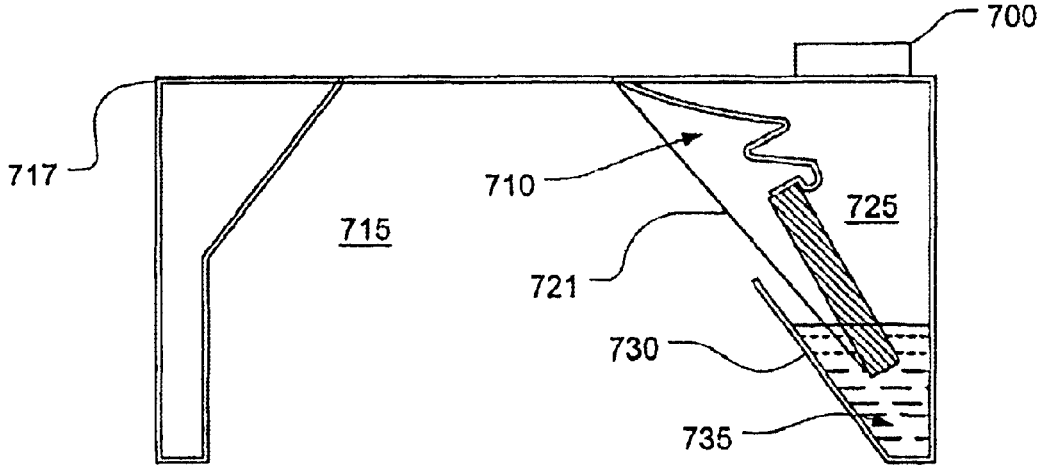
FIG. 24B. is a section view of the flow throttling device of FIG. 24 day in the throttle-down position.

Referring to FIGS. 24A and 24B, a canopy 717 has a recess 715 bounded, in part, by a flexible accordion wall 710, a filter 720, and a water tank 730. The filter 720 is partly immersed in a pool of water or other liquid 735, held by the tank 730. The exposed face of the filter is limited by the immersion of part of the filter 720 in the pool of water 735 and thus the flow area is reduced. As a result, the flow area may be modulated by varying how deeply the filter 720 is immersed. By varying this flow area, the pressure drop between the recess 715 and a plenum 725 may be selectively varied to vary the exhaust flow. To vary the depth of immersion, the filter 720 may be translated. The flexible accordion wall 710 flexes to follow the filter 720. The flexible accordion wall 710 may be made of steel or some other material. The filter may be held by a suitable engagement device (not shown) at the distal end of the flexible accordion wall 710. Cleaning solution may be used in the tank 730. During shutdown of the exhaust system, the filter 720 may be immersed more completely in the cleaning solution to clean the filter 720.

Figure 24C:
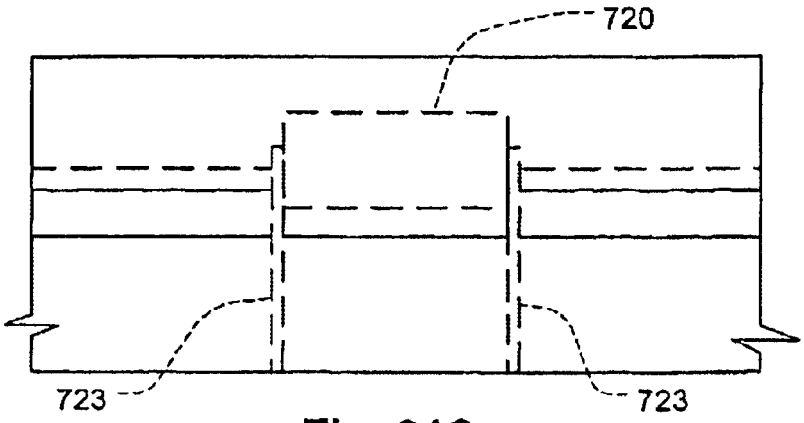
FIG. 24C. is a top view of the embodiments of FIGS. 24A and 24B.

Referring now also to FIG. 24C, seal plates 723 prevent effluent gases from bypassing the filter 720 by going around it. The seal plates may extend from the top of the accordion wall 710 to the level of the liquid 735.

Figure 25A:
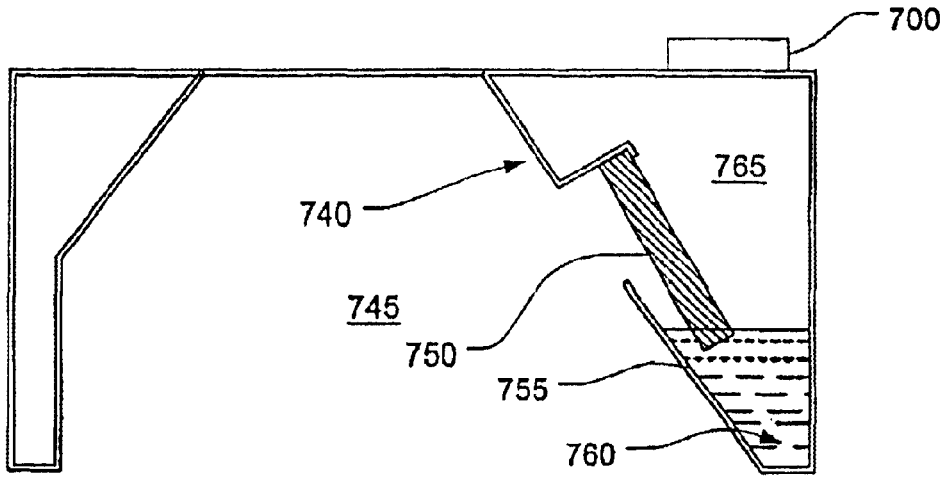
FIG. 25A is a section view of a flow throttling device also using A cleaning fluid according to embodiment of the invention.
Figure 25B:
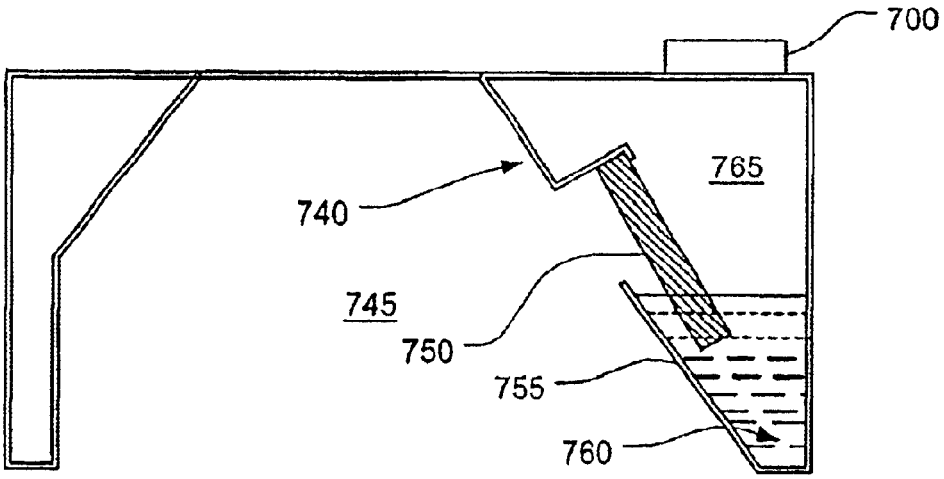
FIG. 25B is a section view of the flow throttling device of FIG. 25 a in a throttle-down position.

Referring now to FIGS. 25A and 25B, in another embodiment, a recess 745 is bounded in part by a fixed wall section 740 to which a filter 750 is connected at a distal end thereof. Seal plates (not shown) may be provided as in the embodiment of FIGS. 24A–24C. The filter is immersed partly in a tank 755 filled with water or a cleaning solution or some other liquid 760. Pressure drop between a suction-side plenum 765 and the recess 745 across the filter is governed by the level of the liquid 760 in the tank 755 which in turn controls the flow area available through the filter. In FIG. 25A, the flow area is greater than the illustration of FIG. 25B because the liquid 760 level is higher in the latter figure.

Figure 26:
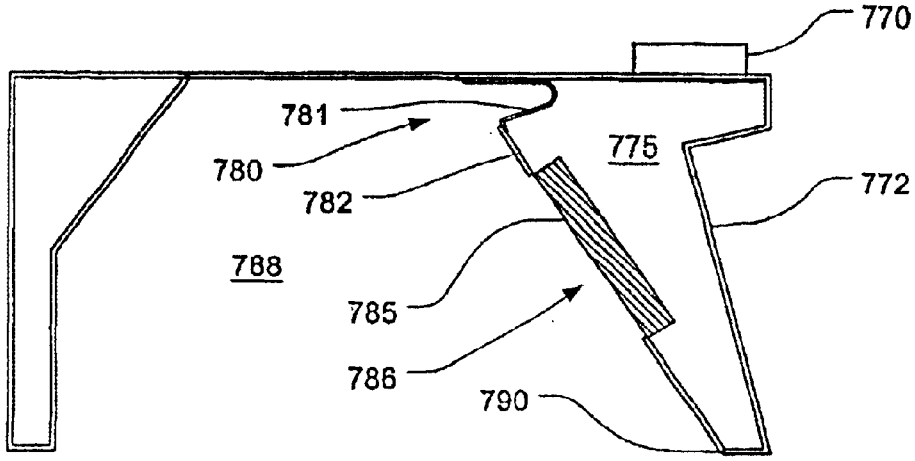
FIG. 26 is a section view of a canopy hood showing a flow throttling device in which apply them is contracted according to embodiment of the invention.
Figure 27:
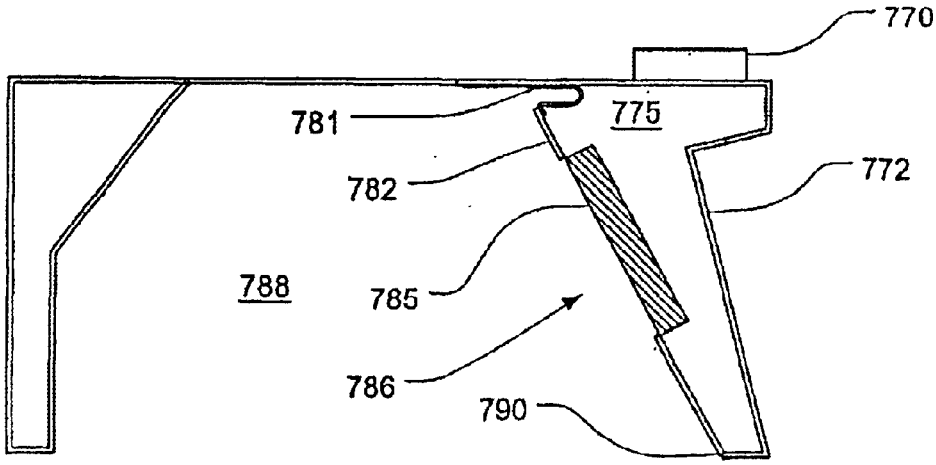
FIG. 27 is a section view of the embodiment of FIG. 26 in throttle-down position.

Referring now to FIGS. 26 and 27, a recess 788 of an exhaust hood 789 is defined in part by a pivoting wall 781 that pivots at one end 790 and is connected by a flexible wall 781 at another end. The pivoting wall 781 also defines in part a suction side plenum 775 whose flow passage is reduced in flow area by the change in the angle of pivot of the pivoting wall 781. The flow through each controlled vent 786 may be modulated by means of an independent apparatus as shown. Thus, for balancing flow through a single hood, two or more sets ("sets" may be single in number) of vents may lead into separately controlled plenums 775.

Figure 28A:
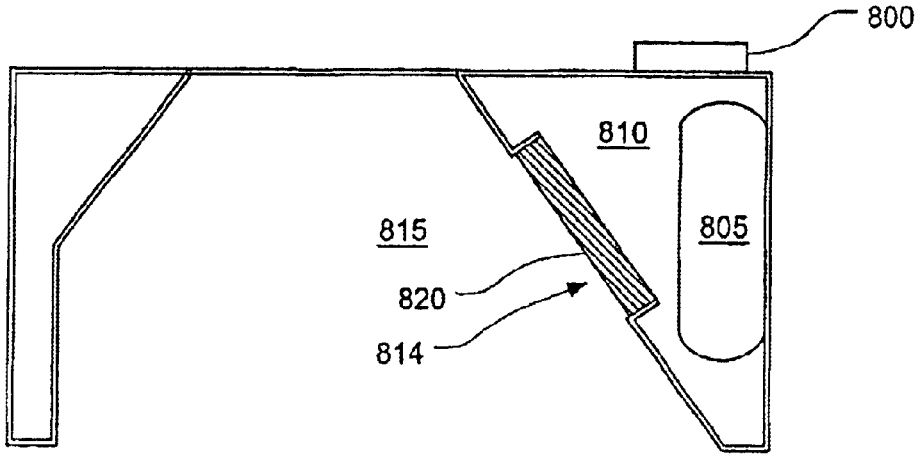
FIG. 28A is a business section view of the canopy hood showing a flow throttling device employing an expandable bladder according to embodiment of the invention.
Figure 28B:
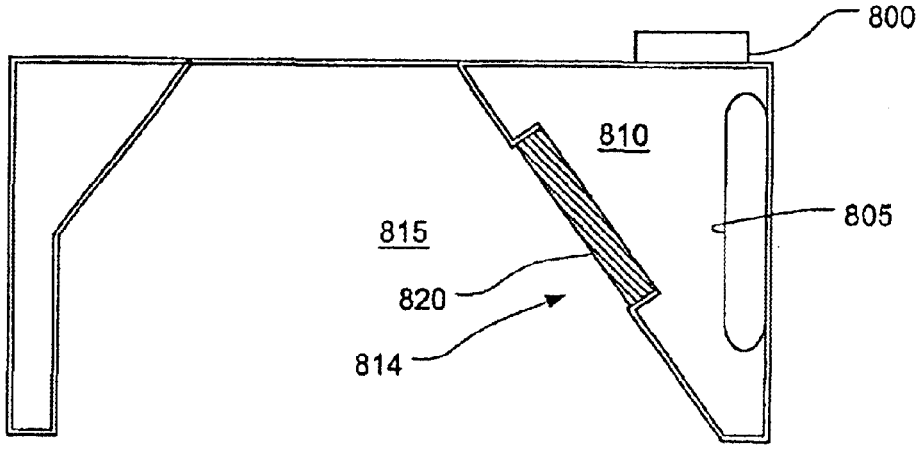
FIG. 28B is a section view of the flow throttling device of FIG. 28 a in throttle-down position FIG. 29 to section view of a canopy hood with a flow throttling device employing a flexible back wall of a plenum according to embodiment of the invention.
Figure 29:
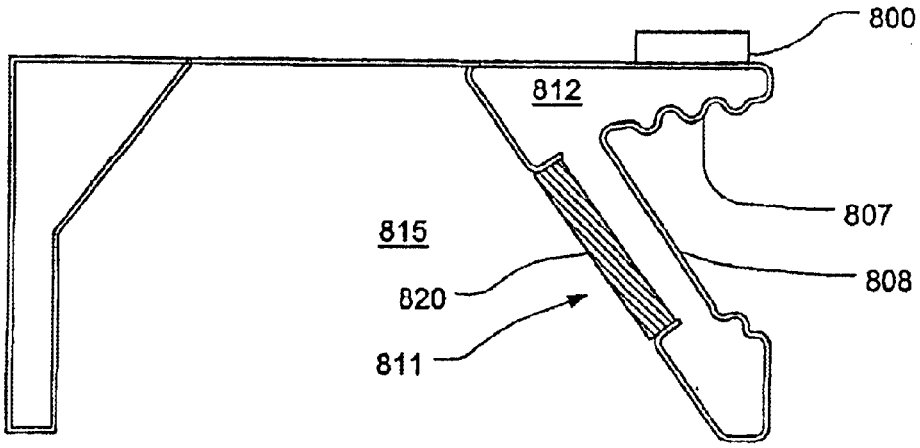

Referring to FIGS. 28A and 28B, a hood canopy 815 has a plenum 810 that receives exhaust air through a filter 820. The pressure drop through the plenum 810 is modulated by varying the configuration of an obstruction 805. The obstruction may, for example, be an inflatable bladder. The obstruction may be made of steel with an accordion type bellow integral thereto to permit its volume to vary. Alternatively, it may be of polymeric material or other suitable construction. The obstruction 805 is shown with a substantially pillow shape, but it is understood that it could have any shape. A shape that presents a face that is substantially parallel to the exit face of the filter 820 would be better than one that is at a substantial angle as shown so as not to favor one portion of the filter over another. Referring to FIG. 29, in a variation of the embodiments of FIGS. 28A and 28B, wall of the plenum 810 has a face 808 and accordion ribbing 807 to permit the face 808 to be pushed into the plenum 812 to vary the flow channel area and thereby the pressure drop through the plenum. The same effect would be accomplished with an obstruction as in FIGS. 28A and 28B. That is, the face angled as face 808 could be formed in the obstruction 805.

In the embodiments of FIGS. 28A, 28B, and 29 separate plenums 810/812 may be provided for each modulated vent 814/811. Alternatively, however, because the flow obstructor 805/808 may be made local to a respective vent 814/811, all vents may share a common plenum 810/812 for a single hood while still providing the ability to balance a single long hood. That is, a separate and independently controllable flow obstructor 805/808 may be made respective to each vent 814/811 to control each controlled vent independently of the others.

Figure 30:
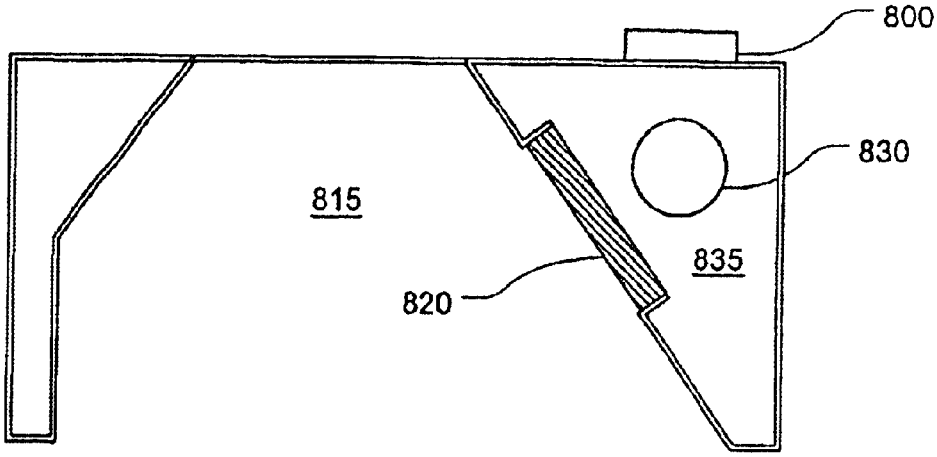
FIG. 30 is a section view of a canopy hood with a flow throttling device using a ball bowel arrangement according to embodiment of the invention.
Figure 31:
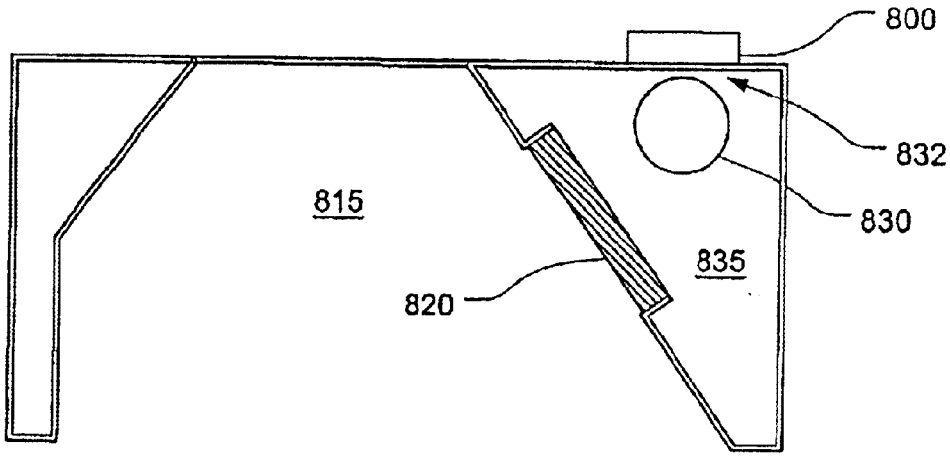
FIG. 31 is a section view of a canopy hood with the flow throttling device of FIG. 30 in throttle-down position.
Figure 32A:
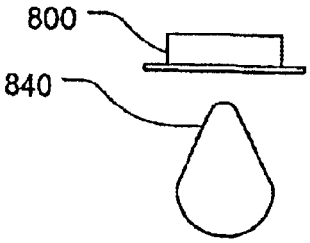
FIGS. 32A and 32B are side views of an alternative bowel arrangement suitable for use in the embodiment of FIGS. 30 and 31.
Figure 32B:
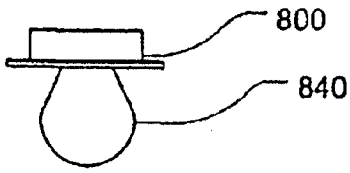

Referring to FIGS. 30 and 31, a hood of substantially standard construction has a suction side plenum 835 which draws air through a filter 820. An aperture 832 leads to an exhaust collar 800. The aperture 832 is selectively blocked by a smooth obstruction 830 whose distance from the aperture 832 determines the flow area for exhaust flow through the aperture. In an embodiment, the flow obstruction 830 is in the shape of a sphere. Referring to FIGS. 32A and 32B, an alternative shape for a flow obstruction 840 is a water-drop shape. For rectangular flow apertures 832, other shapes may be used. Preferably, the shape of the flow obstruction is smooth so as not to generate stable and quasi-stable or periodic flow structures that result in undue precipitation of aerosols.

Figure 33:
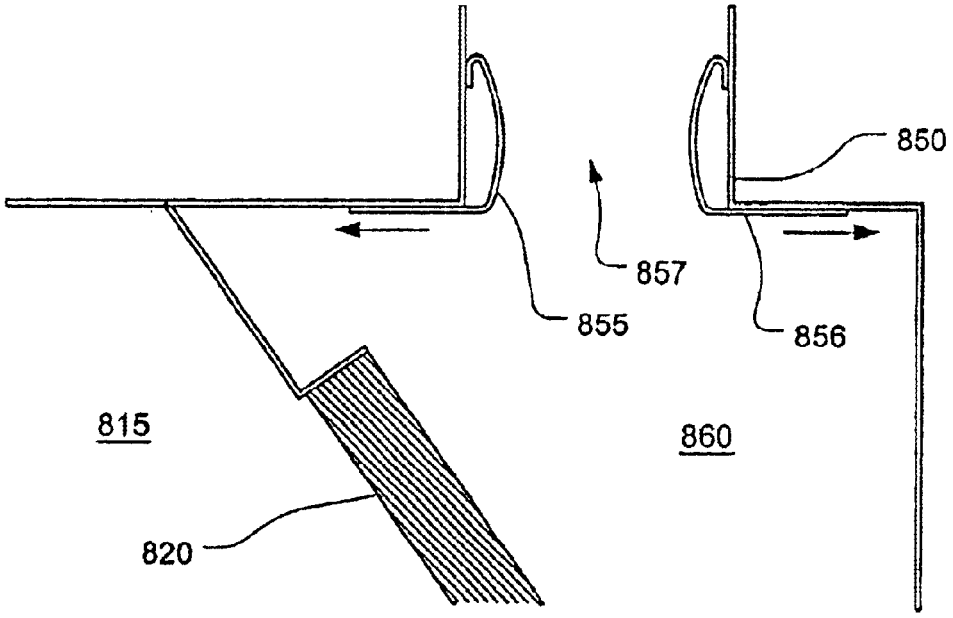
FIG. 33 is a section view of a flow throttling device for a hood and a throttle-up position according to an embodiment of the invention.
Figure 34:
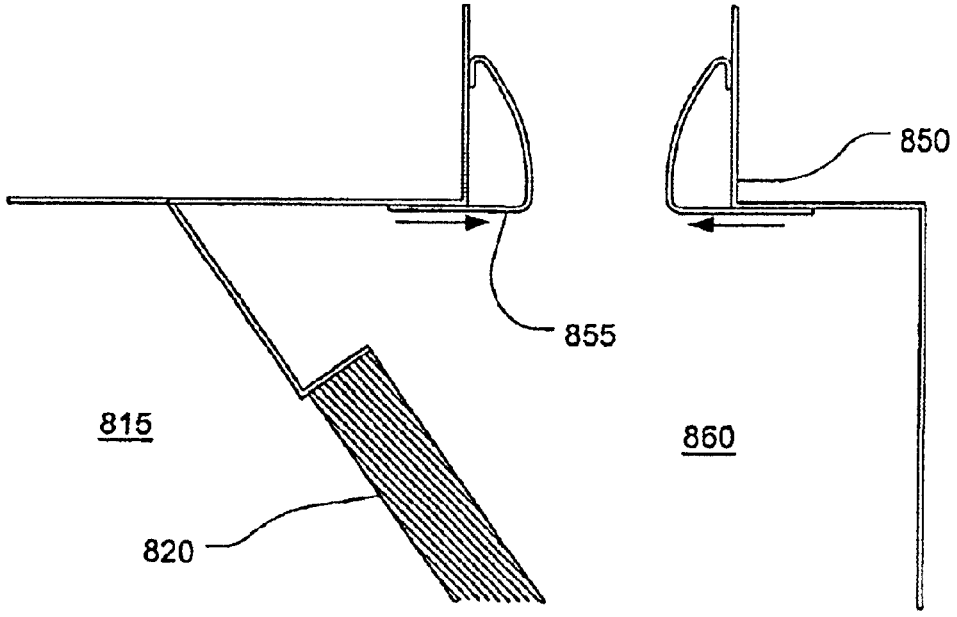
FIG. 34 is a section view of the flow throttling device of FIG. 33 in a throttle-down position.

Referring to FIGS. 33 and 34, in a rectangular exhaust collar 850 fed from a suction side plenum 860 of an exhaust hood, flexible smooth flow obstructor plates 855 are provided. By varying the shape and area of a flow channel 857, the pressure drop across the flow channel 857 is modulated providing the ability to balance suction side plenums 860 selectively. The shapes of the obstructor plates 855 may be varied by translating tongue segments 856 accordingly. The final actuator used to vary the shape and size of the flow channel 857 may be any suitable device. Note that one side only may be translated rather than both as indicated.

Figure 35:
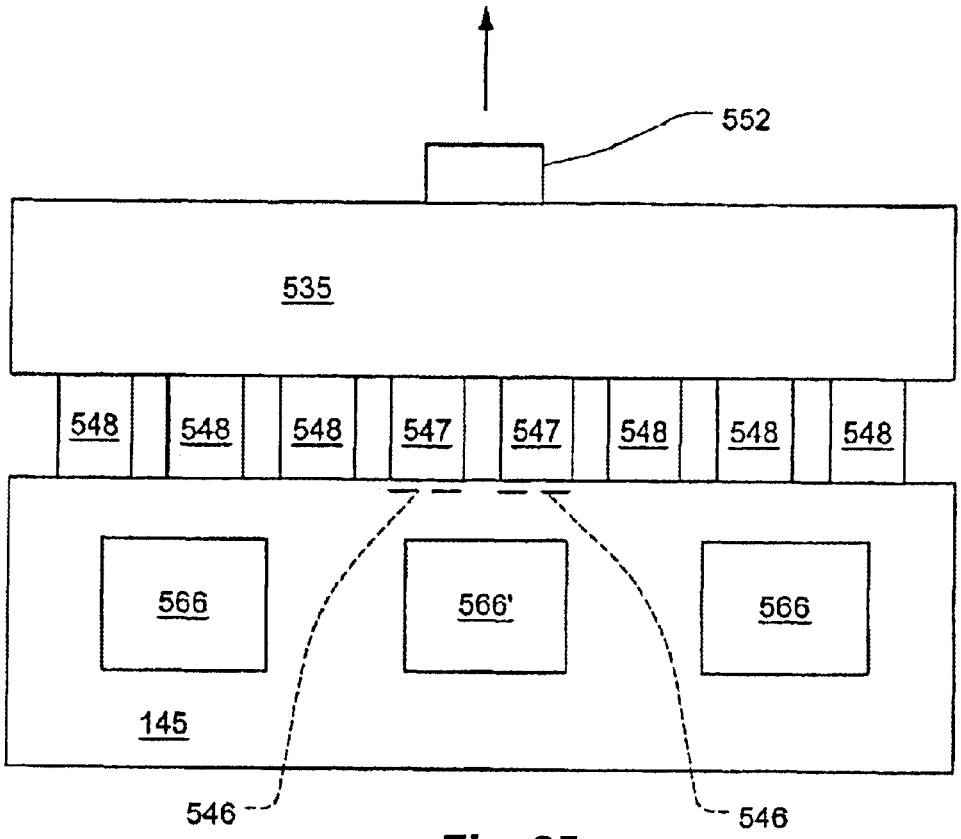
FIG. 35 is a front view all long hood with multiple vents and multiple duct sections which may be selectively blocked according to embodiment of the invention.
Figure 36:
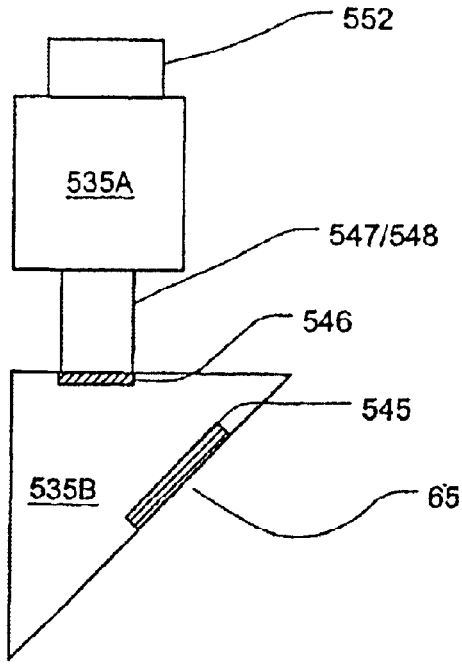
FIG. 36 is a section side view of the embodiment of FIG. 35.

Referring to FIGS. 35 and 36, an exhaust hood has a suction side plenum 535A divided into an upper part 535A and a lower part 535B. The upper and lower parts 535A and 535B are connected by a series of duct sections 547/548 that may be selectively covered with blanks 546 to vary the flow through each respective vent 566. In the example situation shown in FIG. 35, two of the middle-most blanks are set to block flow through ducts 547 and permit free flow through ducts 548. By selectively blocking some ducts 547 and permitting flow through other ducts 548, the relative flow of the vents 566 is altered. For example, the flow through vent 566' would be reduced relative to the flow through adjacent vents 566 because of the presence of the blanks 546. Since no obstructions are added to a flow path, no mechanism is introduced that would cause undue precipitation.

Note that while in the embodiment of FIGS. 35 and 36, the blanks 546 are fixed in place, it would be possible to arrange for the blanks 546 to be selectively moved into place to provide real-time modulation of flow. Thus, in this embodiment, a movable blank 546 would either be in place blocking flow through a respective duct section 547 or it would be out of the way permitting free flow through the respective duct section 548. Also, while in the embodiment described above, it was presumed that the configuration of the plenum 535B was such that flow through the middle vent 566' would be appreciably reduced relative to that through the other vents 566, the latter plenum may be sufficiently generously sized that the only effect of reducing the aggregate flow area by blocking ducts 547 may be to reduce the total flow for the entire hood without redistributing the flow along the hood. Thus, this design may be used to balance multiple hoods or single hoods, as may all the previous embodiments. The advantage of using this technique rather than a single flow control, however, is that it does not create any obstruction around which fumes and air must flow. Thus, it avoids the attending precipitation problems.

Figure 37:
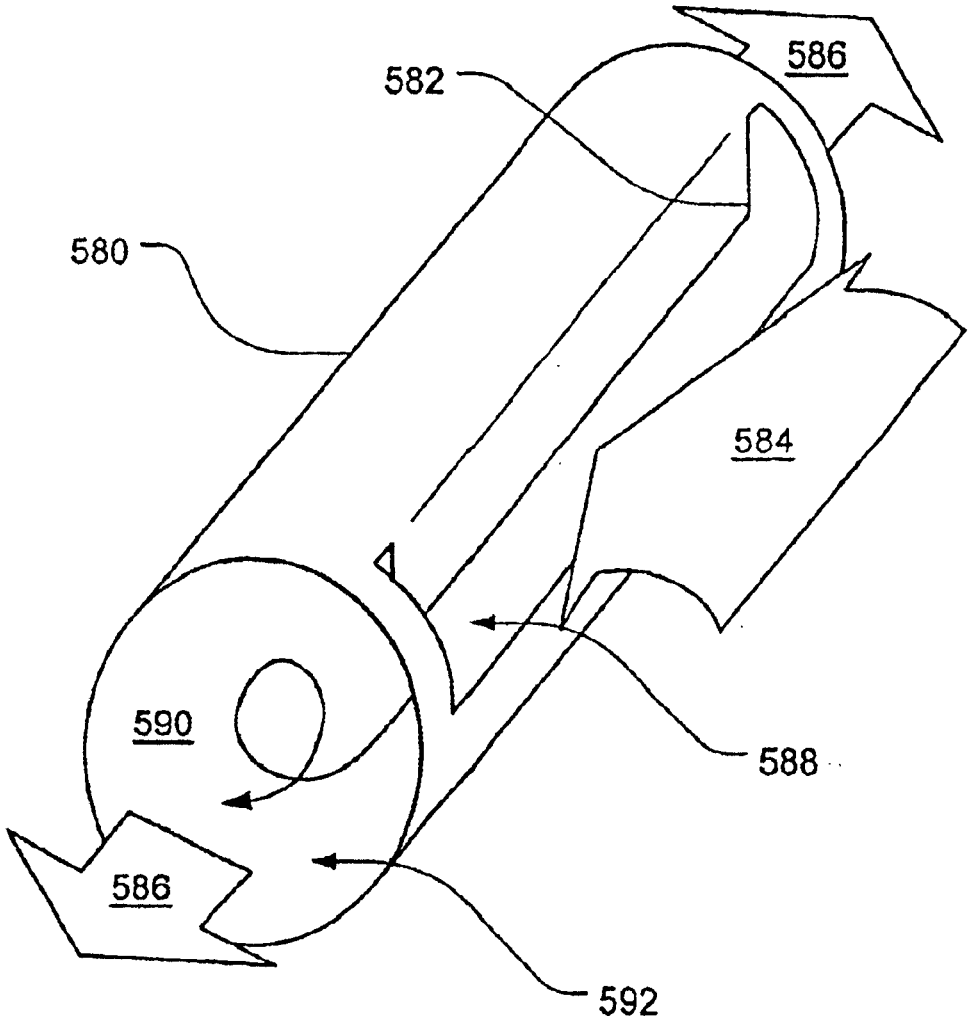
FIG. 37 is a perspective view of a cylindrical module of a combination filter/flow throttling device according to an embodiment of the invention.

Referring to FIG. 37, a cylindrical grease filter module 580 has in inlet 588 through which raw effluent and air are drawn and an outlet 592 from which the cleansed air is extracted. A guide van 582 causes an incoming stream 584 to be directed into a helical flow 590 so that grease and other airborne particulates precipitate on its interior walls. The exit flow 586 is directed at approximately a right angle to the incoming stream 584. Functionally, the cylindrical grease filter module is similar in function to that of the filters described in U.S. Pat. No. 4,872,892. Its cylindrical walls, however, may provide lower resistance and improved cyclonic flow therewithin.

Figure 38:
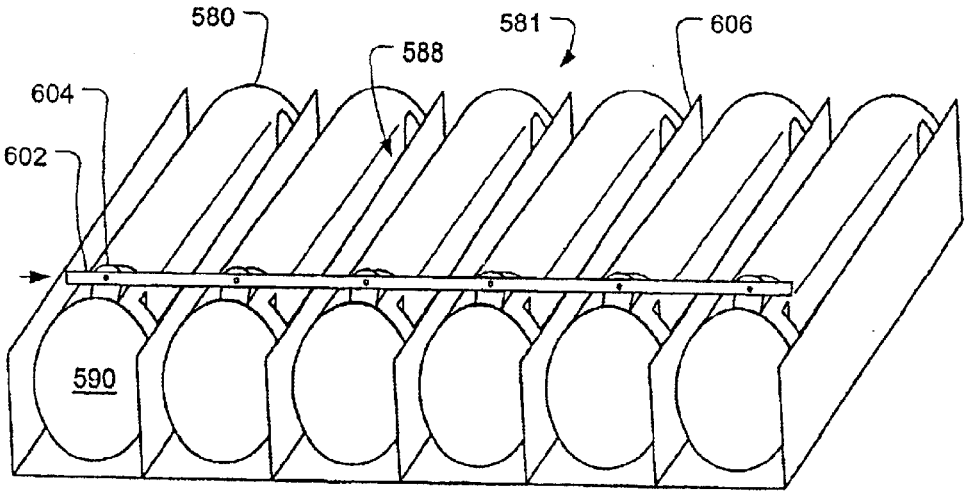
FIG. 38 is a perspective view of a combination filter/flow throttling device employing the module of FIG. 37 and a rotating assembly.
Figure 39:
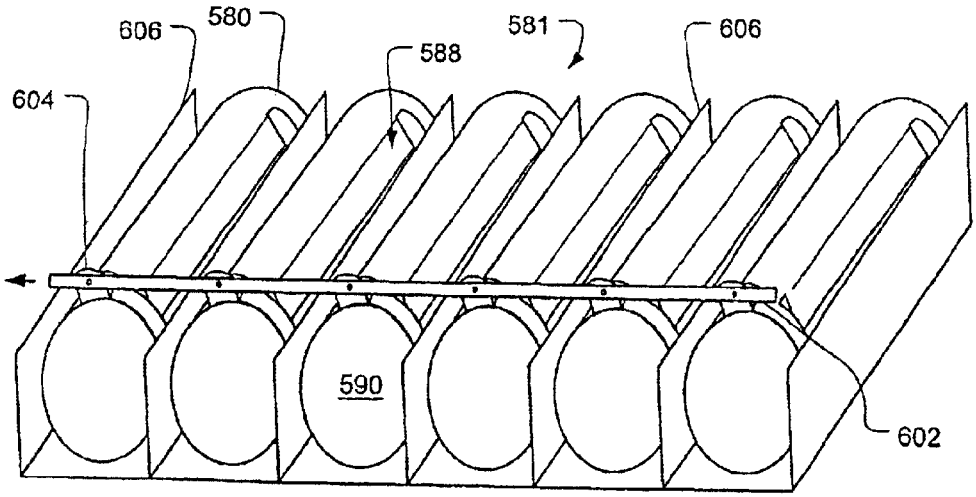
FIG. 39 is a perspective view of the embodiment of FIG. 38 and a throttle-up position.

Referring to FIGS. 38 and 39, a filter cartridge 581 is formed from multiple cylindrical grease filter modules 580. Each cylindrical grease filter module has a lever tab 604 which is tied to a rotator bar 602 which is used to rotate the cylindrical grease filter modules 580 in concert. By rotating the cylindrical grease filter modules 580, the exposed area of the inlet 588 of each cylindrical grease filter module 580 is selectively altered. When the cylindrical grease filter modules 580 are in the positions shown in FIG. 38 the flow through the filter cartridge 581 is restricted more than when they are in the positions shown in FIG. 39. This is because the inlets 588 are increasingly blocked by partitions 606 as the cylindrical grease filter modules 580 rotate clockwise. Note that in an alternative embodiment, the cylindrical grease filter modules 580 may be set immediately adjacent to each other and the blocking function of the partition plate formed by the external surfaces of adjacent cylindrical grease filter modules 580. In this way, the partition plates 606 may be avoided.

Figure 40:
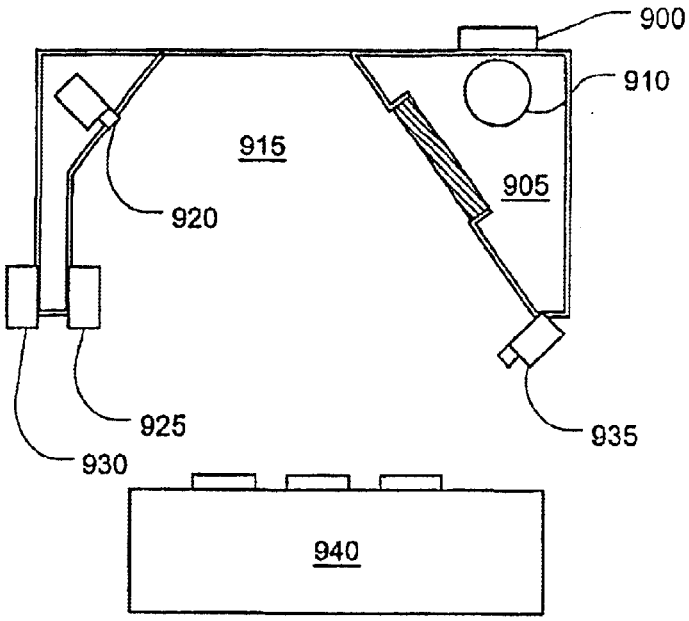
FIG. 40 is a section view of a canopy style hood sensors to gather data about cooking conditions.
Figure 41:
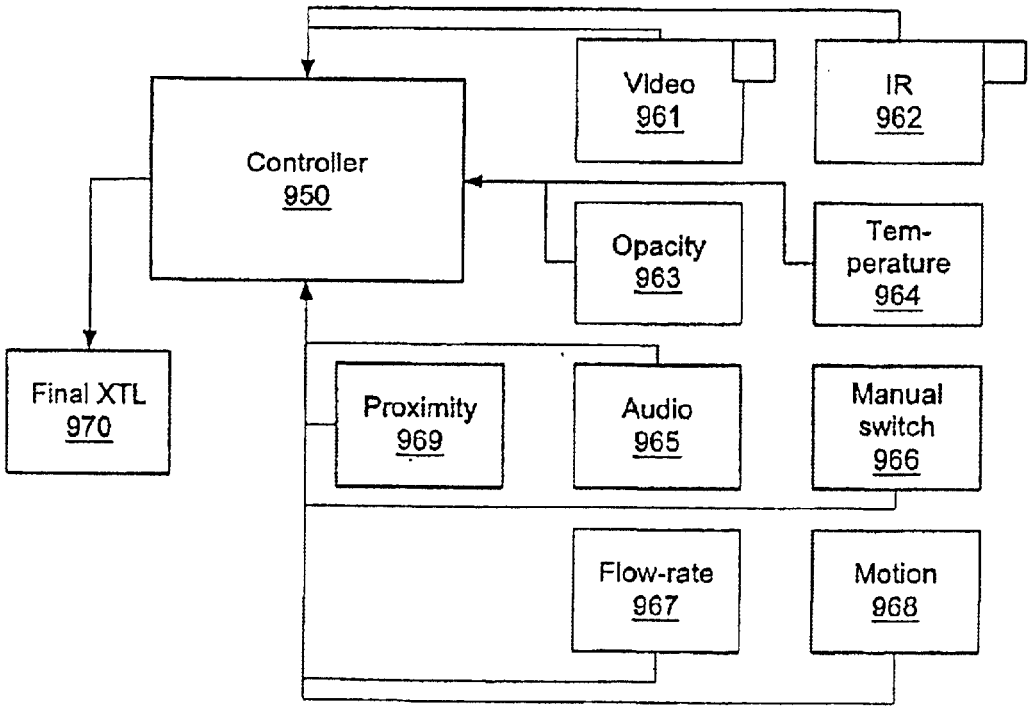
FIG. 41 is a blocked side man of the controller with sensors for controlling the balance of one or more kitchen exhaust hoods.

Referring to FIGS. 40 and 41, various sensor mechanisms may be used to provide real time control of the flow rate through one or more hoods. For example, a controller 950 may receive input signals from one or more input devices including one or more video cameras 961, infrared video cameras 962, opacity sensors 963, temperature sensors 964, audio transducers 965 (e.g., microphones), manual switches 966, and flow rate sensors 967. Based on one or more of these inputs signals the controller may control the setting of one or more output controllers 970 connected to any of the flow control devices described previously or described later in the present specification. Video or IR cameras may be located at any desired position, examples being indicated at 920 and 935 and as discussed later in connection with FIG. 42. Opacity and temperature sensors may be located at any positions, two examples being indicated at 925/930.

The technology in image processing is more than adequate to detect a change in a volume of smoke or heat resulting from an increased cooking load. Optical and/or infrared images may be captured and a cooking load indicator derived therefrom. For example, an IR image processing algorithm that simply indicates the percentage of the field of view that is above a temperature threshold may thereby indicate escape of a thermal plume from a hood; i.e., a loss of capture and containment due to the thermal plume rising in front of the external edge of the hood. As such a loss of containment is approached, the hot buffer zone tends to grow from deep within the recess until it breaches the capture zone. This growth of the buffer zone can be indicated in precisely the same way: by imaging a predefined field of view and recognizing the size and/or shape of the hot zone (the latter being defined as a zone in which the imaged temperature exceeds a predefined threshold). This is discussed further below.

The movement of a worker, the image of the food being cooked, the presence of smoke at particular locations (such as escape of containment at the edge of the hood), the temperature of air near the hood or within the canopy recess, the proximity of a worker, etc. may all be combined to form a classification input-vector from which a condition (e.g., percentage of full-load) classification may be derived. Algorithmic, rule-based methods may be used. Bayesian networks or neural network techniques may be used. Alternatively, just one sensory indicator of load may be used to determine the current load. For example, a gas rate flow sensor for a gas grill could provide the single input signal. Many possibilities are available with current sensor, machine-classification, and control technologies.

Figure 42:
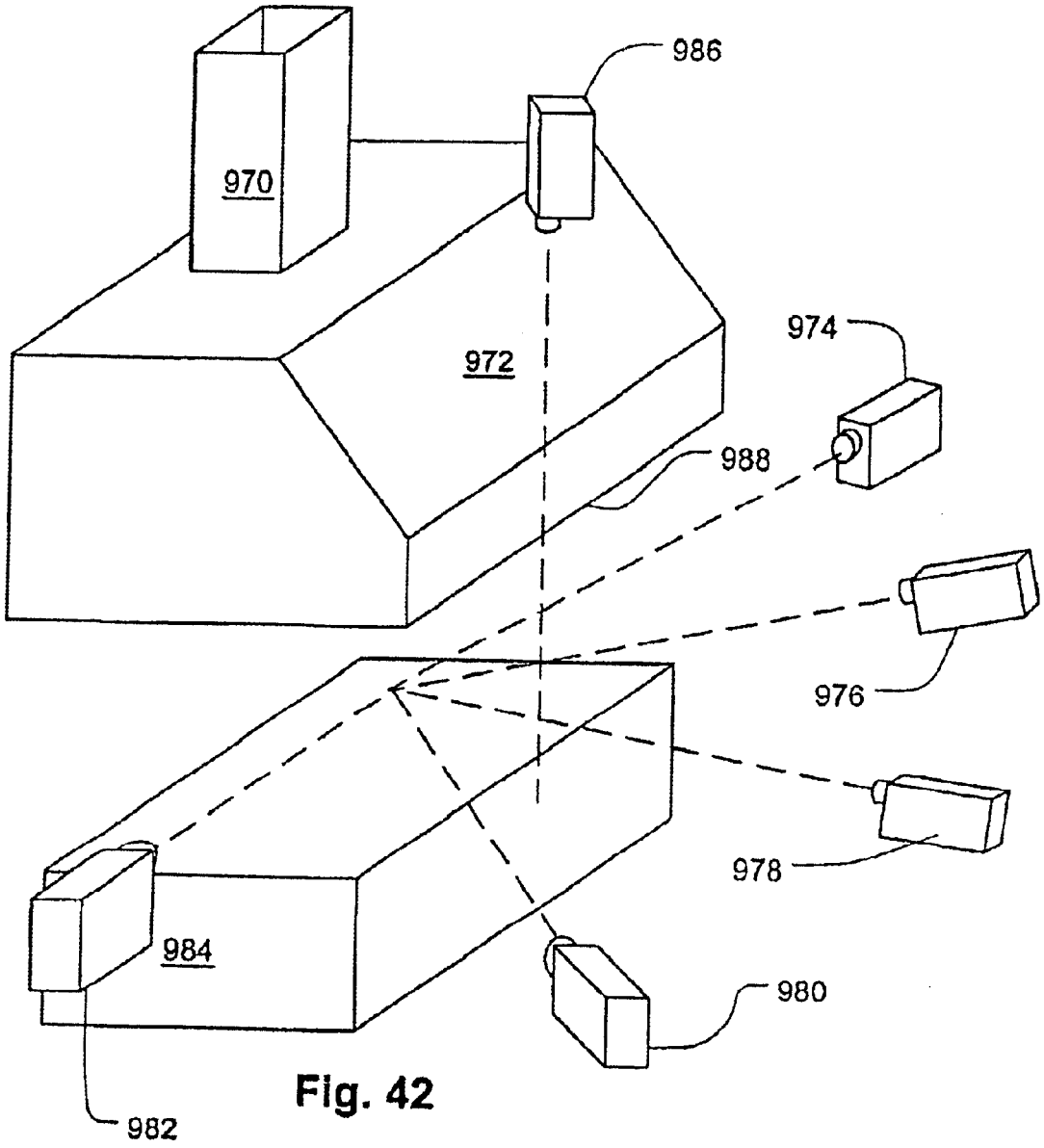
FIG. 42 is a perspective view of a cooking appliance and hood showing various camera angles.
Figure 43A:
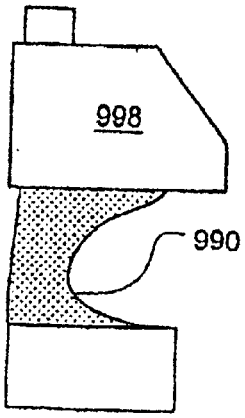
FIG. 43A is a side view of a hood and cooking appliance with a plume in which the exhaust rate is higher than necessary.
Figure 43B:
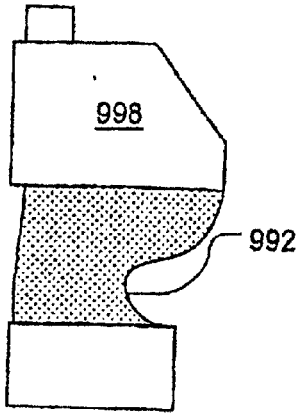
FIG. 43B is a side view of a hood and cooking appliance with a plume in which the exhaust rate is set at an optimal rate.
Figure 43C:
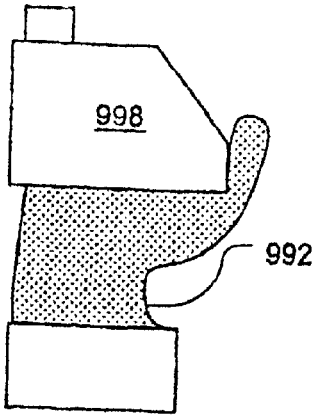
FIG. 43C is a side view of a hood and cooking appliance with a plume in which the exhaust rate is set to low.

Referring to FIG. 42, various camera angles may be employed in a load-classifier that employs optical or IR images. For example, a camera 982 is positioned to image a side view of a canopy 972, range, 984, and a work area between and adjacent them. Referring also to FIGS. 43A–43C and 44, in an IR-based camera, this side view can image a hot zone whose size and shape are dependent on effluent load (which includes heat) and exhaust rate. FIG. 45 is a Schlerian image, but the shape of the hot plume is essentially the same as what would be provided by a thermal camera. As the exhaust rate falls below that necessary to provide capture and containment, a hot zone image provided by the camera 982 would expand progressively as illustrated in the series of FIGS. 43A–43C. The hot zone changes from one associated with adequate capture and containment 990, to one on the verge of breaching 992, to one where capture and containment has been lost 994. The changes in the images, the rate of change of images, and the history of change of the images may be employed in a control system as described to insure that capture and containment is maintained.

Figure 44:
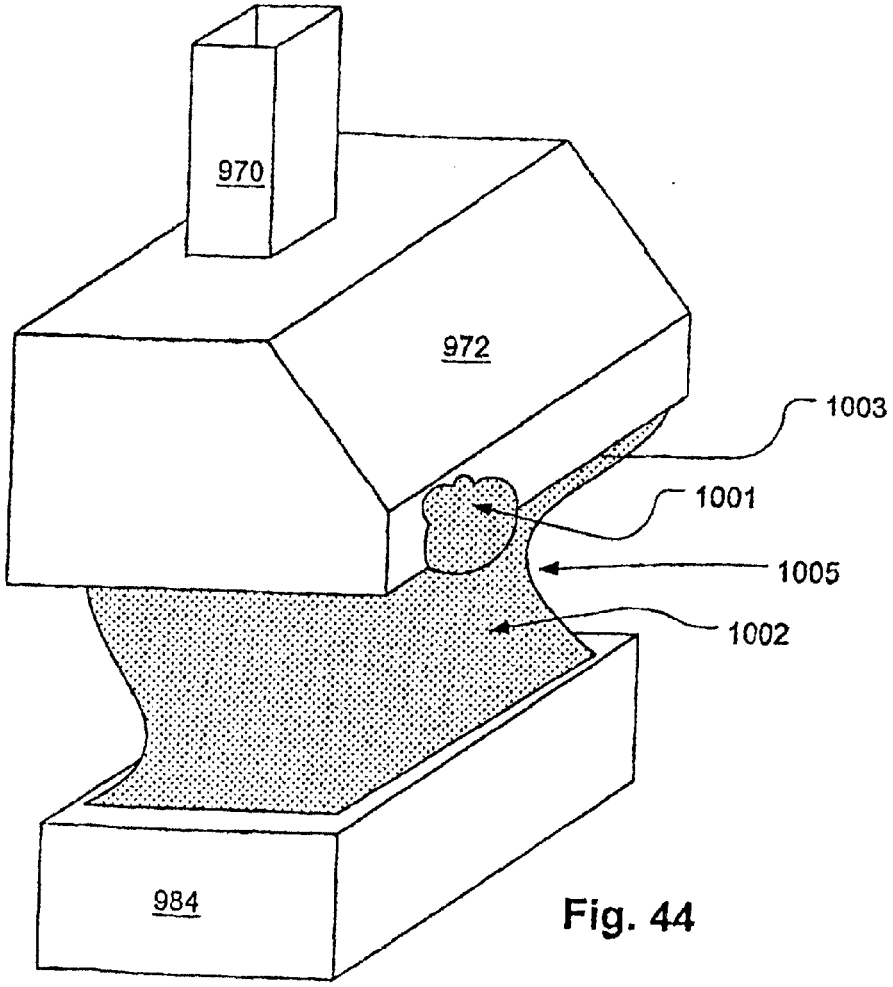
FIG. 44 is a perspective view of a canopy quoted and cooking appliance showing a plume escaping containment.
Figure 45:
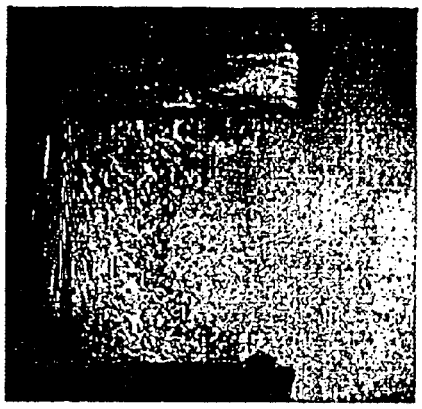
FIG. 45 is a Schlerian photograph of the thermal plume rising from a cooking appliance into a canopy hood.

Referring now to FIG. 44, other camera angle views such as provided by camera 980 may provide more information about the particular location of the exhaust rate deficit along the canopy 972 edge 1003. Illustrated in FIG. 44 is an oblique view of a canopy and plume 1002 showing a spillover 1001 over an edge 1003 near an end of the canopy. This image may be used to provide an adjustment to exhaust flow rate favoring the portion of the canopy 972 close to an end thereof, as illustrated. The ability to detect spillover and its position along the edge 1003 may be obtained by positioning a camera 986 looking downwardly so that it captures the entire front edge 988/1003. By taking multiple images, such as provided by cameras 974, 980, 982, and 976, it is possible to compare the shape of the three dimensional plume to determine an imminent spill. Thermal plumes have a characteristic waist 1005 that results from the increase in velocity and the draw of cooler air as they rise. This waist begins to bulge at the top as capture competency is lost. Again, the spillover can be detected as a three-dimensional model based on temperature or opacity.

The model or two-dimensional image(s) may be graded or thresholded. The image resolution need not be high since the structures are highly repeatable and their variability quite distinct. Thus, a relatively inexpensive imaging device may be employed with a small number of pixels. The classification process must include unrecognized classes and be capable of indicating same. For example, if the view of a camera is occasionally obstructed, the image processing process should be capable of recognizing the absence of an expected image and responding to it. Images that change suddenly or do not belong to a recognized plume shape may be classified as a bad image. The response to a bad image may be to ignore it or alternatively to ramp the exhaust rate to a design maximum until a recognized image is acquired again. Fiducial marks or particular features of the exhaust or cooking equipment may be employed to help determine if the camera view is obstructed. The lack of such features or fiducials in the image may indicate the loss of the image.

Activity can be indicated by live camera images, IR and optical. For example, the presence of an operator near the working area of a cooking appliance may be used as a signal indicating that the cooking load is increased. The particular activities in which the operator is engaged are likely to be highly repeatable events and readily classifiable by video classification methods as a result. For example, a particular stage of cooking may be characterized by the laying out of many pieces of meat on a hot grill. The movement of a worker's arms over the hot grill placing the meat is an activity that may be readily classified since it has distinct characteristics that distinguish it from other background activities such as cleaning or walking around the grill. Classifying the event of placing the meat on a grill may trigger a timer to anticipate when the load reaches a maximum.

Neural networks may be trained to classify the conditions in a kitchen using neural network techniques. The inputs from multiple devices may be combined to form a vector. The following are possible vectors.

1. Cameras
   a) Thresholded image (reduce to 1-bit map; all temperatures (radiative) or light levels above a threshold are one color and all temperatures or light levels another color. Process image to identify contiguous domains and form an area-number histogram by counting the number of domains falling within each of series of size ranges. The histogram values define a vector. The contiguous domains can be further processed to define feature points and their relationship mapped to a vector in a manner similar to optical character recognition techniques.
   b) Thresholded image may be calibrated to provide high sensitivity to smoke or the range of radiative temperatures associated with a thermal plume characteristic of the cooking appliance. The image processing may be tuned to recognize and distinguish shapes characteristic of thermal plumes for the cooking processes being monitored. The output vector in this case would be a characterization of the particular plume state.
   c) Camera may simply band-pass a color, luminosity, or radiative temperature range and cumulate the total of the image corresponding to that passed signal. This would be scalar. This could be done for a quad tree where the total band-passed image area for each quadrant of the image is passed as a component vector and this could be done down to multiple levels of a quad tree.
   d) Spot temperatures of food and empty areas on a grill or other appliance may be used to predict the load. These may be derived from a single IR image and processed to report the total area, average temperature, or other lump parameters predictive of the load.
2. Opacity sensor
   a) Opacity may be monitored between two points to detect when a plume is swelling. For example, an opacity sensor may be positioned near the inside of the edge 1003 of the canopy 972 and the opacity at that point indicated.
   b) The opacity near multiple points may be monitored and provided as a single vector from which it is possible to deduce the scale of turbulence induced by the thermal plume. (The opacity would be expected to vary over time at different locations along the edge in response to three-dimensional turbulent gusts giving rise to temporal and spatial variability in opacity that can be resolved using multiple opacity signals spaced apart and monitored synchronously.)
3. Audio
   a) A simple frequency profile may be resolved into a histogram whose values correspond to the sound power in each of a series of ranges of audio frequency. The ranges need not be adjacent; they can amount to discrete band pass filters. Depending on the particular cooking process, the sound of frying, grilling meat, operator activity, etc. can make characteristic profiles.
   b) A sound-signature classifier may be employed to add the temporal component to the sound classification. Depending on the type of load being monitored, certain audio signatures may be present and recognized using technology as employed in voice recognition. For example, the sound of a switch being turned on, the sounds of a spatula being used on a grill, etc. are discrete audio events that have temporal signatures that are characteristic to them.
4. Temperature
   a) Sensors placed at various locations may each provide components of a vector.
   b) Sensors may be arrayed to provide a signal indicative of a spatial temperature profile which can be characterized by a more compact set of numbers than simply the whole series of temperatures. For example, the sharpest increases of temperature along respective dimensions may be reported to indicate the location of respective boundaries of the thermal plume 1003.
5. Proximity
   a) The presence of food or other workpieces whose presence is predictive of load, may be sensed. The proximity sensor may be provided as a single signal or multiple signals may provided from multiple sensors. Alternatively, the distance of the object may be sensed using a proximity sensor. For example, something that grows while it is heated could indicate a stage of a varying load.
   b) The presence of an operator and the duration of the operator's presence may be used to signal the load.
6. Motion
   a) The movement of a worker, tools, and/or workpieces may be predictive of the load.

Figure 46:
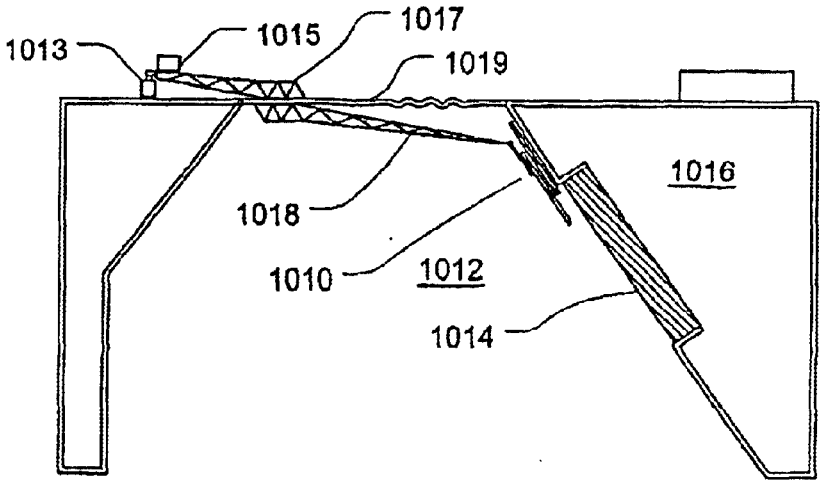
FIG. 46 is a section view of a canopy hood with a shutter and an actuator mechanism according to embodiment of the invention.
Figure 47:
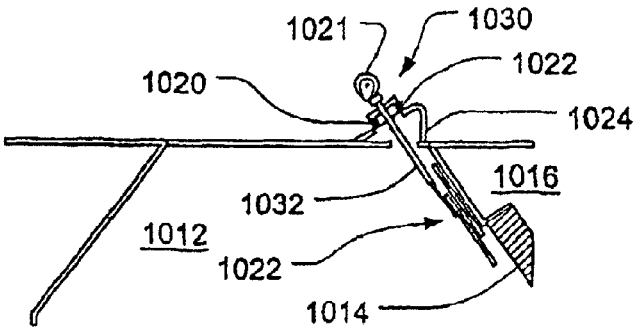
FIG. 47 is a section view of a canopy hood with a shutter and an actuator mechanism according to another embodiment of the invention.

Referring now to FIGS. 46 and 47, a great variety of different kinds of actuators may be employed to operate the various flow control devices described above. Preferably, designs which are tolerant of grease deposition from the effluent. A couple of embodiments are shown to illustrate the range of possibilities, but these by no means are these intended to represent an exhaustive range. The prior art relating to hermetic seals, motor and actuator seals, high temperature, high corrosion environments, etc. are rich with candidate devices that may be employed. In FIG. 46 a lever formed by a first arm 1017 and a second arm 1018 connected through a top wall 1019 of a canopy. The top wall is corrugated to allow it to flex so that when an actuator 1013 pushes the first arm 1017 upwardly, the second arm 1018 moves downwardly actuating a blind mechanism 1010. The embodiment of FIG. 46 thereby provides a hermetic seal between the linear actuator 1013 and the blind mechanism 1010, which provides flow control. In FIG. 47, another actuator embodiment has a motor and cam 1021 that are mounted externally from the canopy recess 1012 which moves a blind mechanism 1022 through a seal 1030 with a bellows 1022 and pushrod 1032. Again the sensitive mechanisms are isolated outside the canopy recess 1012. Many such mechanisms may be employed and a comprehensive discussion of them is not necessary since many suitable mechanisms are described in the machine mechanism prior art.

Figure 48A:
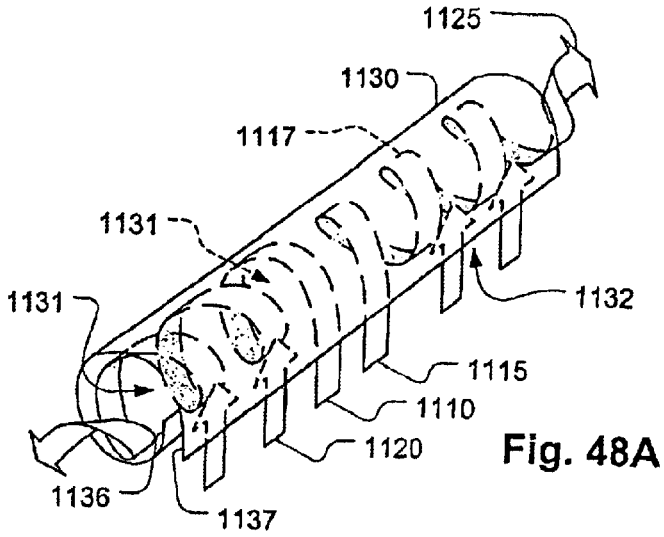
FIG. 48A is a perspective view of expandable scroll module which functions as a filter/flow throttling mechanism according to an embodiment of the invention.

Referring now to FIG. 48A, a scroll shaped module 1130 has an inlet 1132 through which air is admitted as indicated by arrows 1120, 1110 and 115. The admitted air swirls as indicated by helical arrows 1117 and 1110 and exits as indicated by arrows 1125. The helical motion is caused by the fact that the entry point 1132 is at a tangent to the cylindrical space 1131 defined by the scroll shaped module 1130. The entry point 1132 is a gap between an inside distal edge 1136 and an outside distal edge 1137 defined by the scroll shape of the scroll shaped module 1130 and can be increased and reduced in width by flexing the scroll shaped module 1130.

Figure 48B:
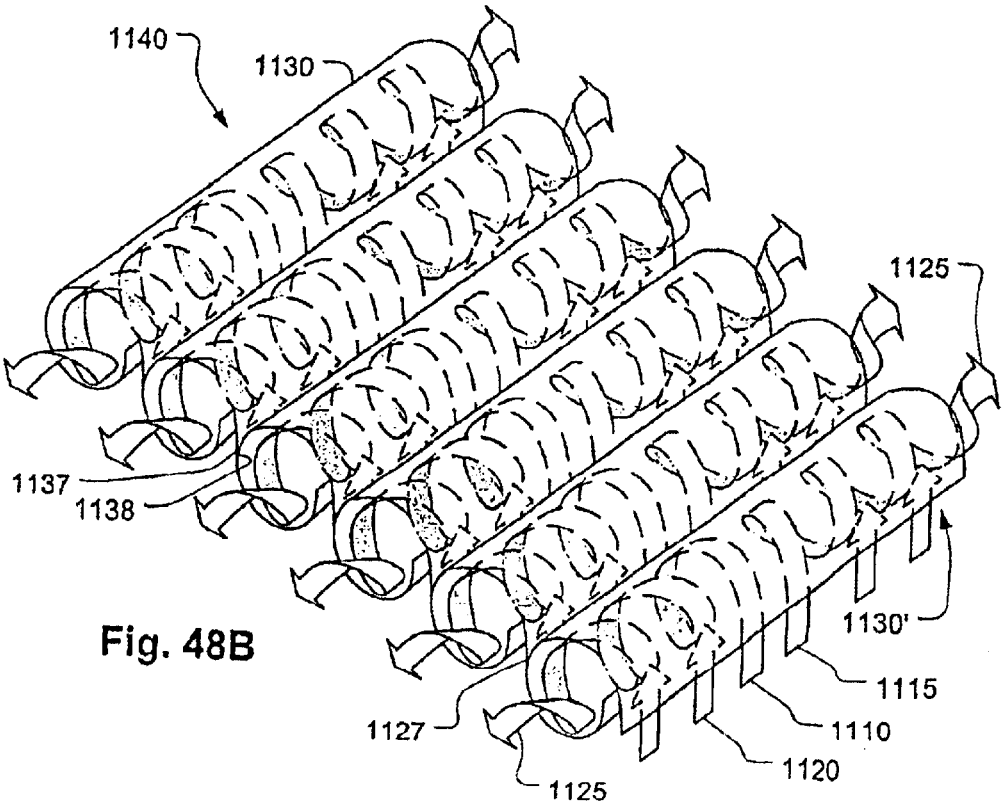
FIG. 48B is a perspective view of a set of the expandable scroll modules of FIG. 48A attached to each other such that they can expand and contract as a unit.
Figure 49:
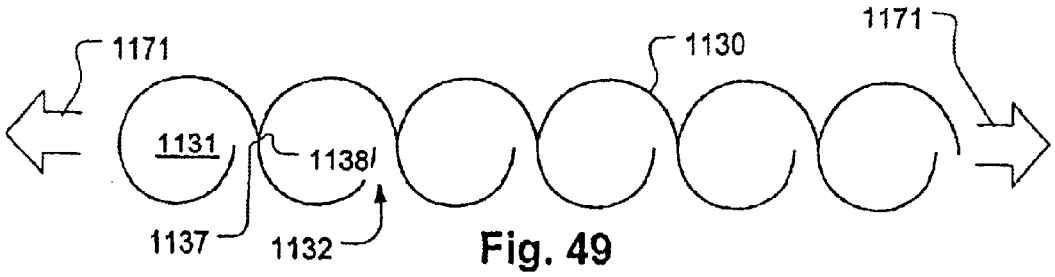
FIG. 49 is a section view of the embodiment of FIG. 48 in a throttle-up position.
Figure 50:
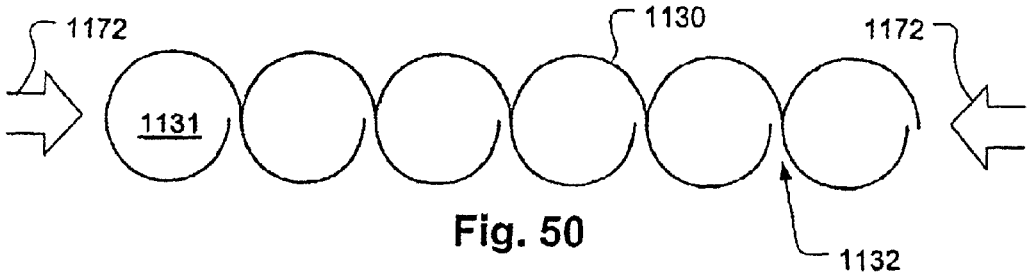
FIG. 50 is a section view of the embodiment of FIGS. 48 and 49 in a throttle-up position.

Referring to FIG. 48B, the scroll shaped module's 1130 are connected to each other to form a filter cartridge 1140. The outside distal edge 1137 of each module 1130 is connected to a middle portion 1138 of an adjacent module 1130 (except for a last module 1130'. Referring to FIGS. 49 and 50, the modules 1130 may be supported in any of a number of ways so that when they are drawn apart (as indicated by arrows 1171) as illustrated in FIG. 49, the inlet 1132 expands and the resistance to the inflow of air is reduced. When the modules 1130 are squeezed together as indicated in FIG. 50 (the force being as indicated by arrows 11, 72), the inlet 1132 contracts and resistance to the inflow of air increases. As a result, the bank of cartridges 1147 forms a combination filter and flow throttling device.

Figure 51:
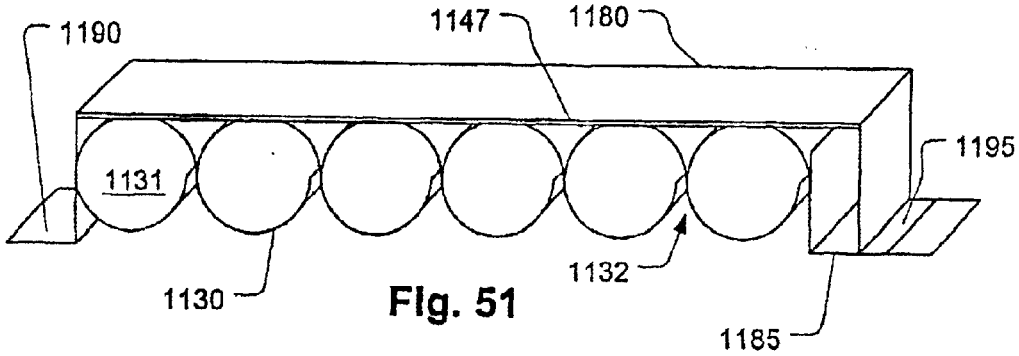
FIG. 51 is a perspective view of the embodiment of FIG. 48 showing a supporting framework and actuator mechanism.
Figure 52:
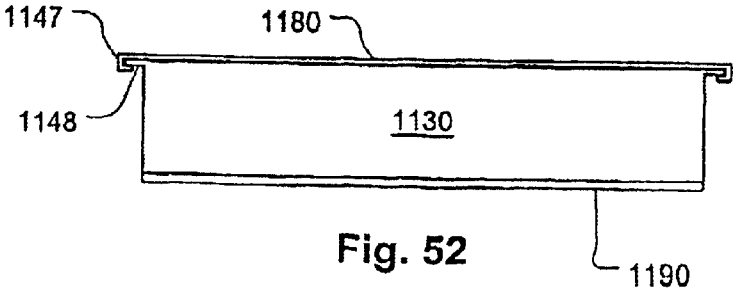
FIG. 52 is a section view of the embodiment of FIG. 51 showing a support feature of that embodiment.

Referring to FIGS. 51 and 52, a support mechanism with a back plate 1180 and L-shaped lower braces 1195 support scroll-shaped modules 1130 by tongues 1148 on each module. The latter fit into channels 1147 formed in the edges of back plate 1180. A sliding L-shaped seal member 1185 is slidably attached to one of the L-shaped lower braces 1195 and moved relative to the back plate 1180 and lower braces 1195 to squeeze and expand the scroll-shaped modules 1130. A tongue 1186 of one of the L-shaped lower braces 1185 is elongated to serve as a seal when the entire device is placed in an exhaust vent.

Figure 53:
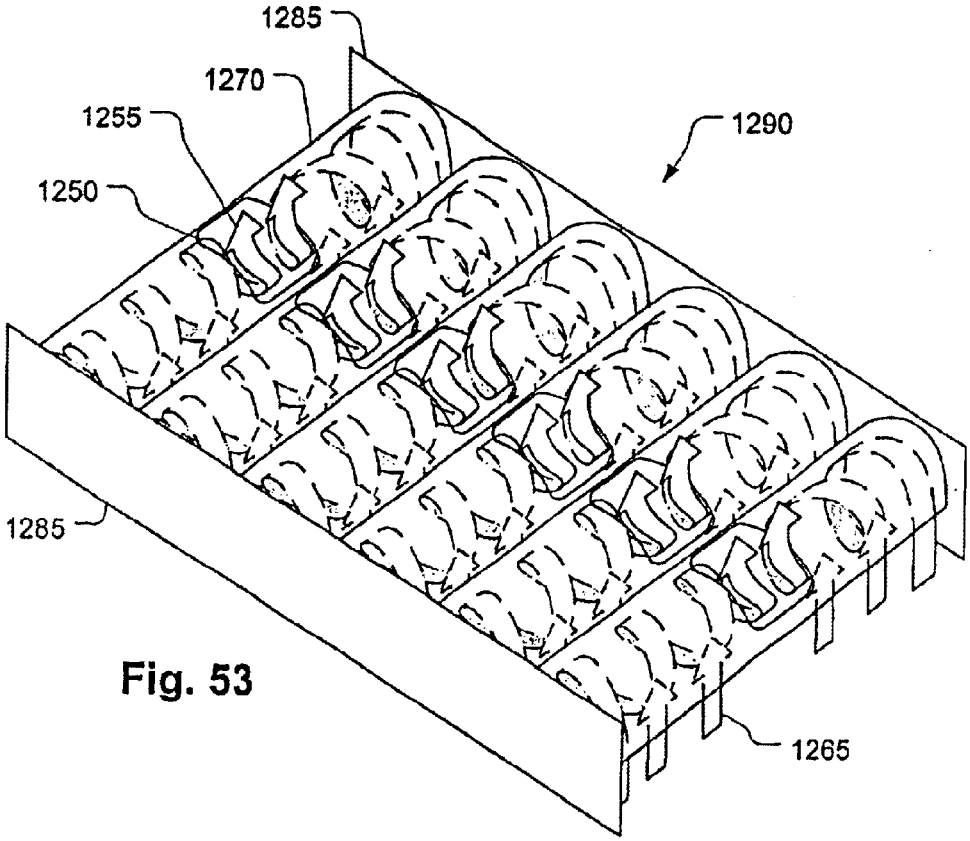
FIG. 53 is a perspective view of an embodiment similar to the embodiment of FIGS. 48A and 48B in which flow exits from a central position between divided sets of scroll modules.
Figure 54:
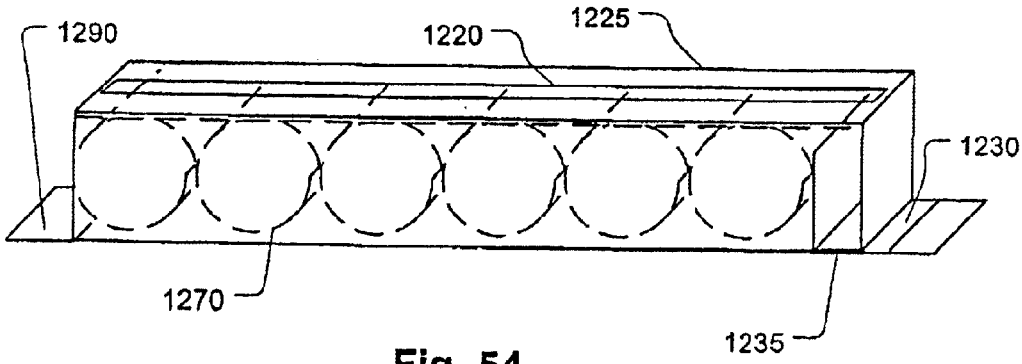
FIG. 54 shows a support structure for the embodiment of FIG. 53.

Referring to FIGS. 53 and 54, in an embodiment that is similar to the previous embodiments, a set of scroll shaped modules 1270 have exits 1255 in the center thereof. Thus, functionally, they are like the modules 1230 of the previous embodiments except that their outlets are toward the middle of the filter device 1299 rather than along its edges. As in the previous embodiment, the air enters tangentially as indicated by arrows 1265 and swirls in a helical motion until it exits as indicated by arrows 1255. Because the air does not need to exit the sides, side panels 1285 may be incorporated in a support structure 1225. A single opening 1220 may be formed in the back (downstream face) of the support structure for air to exit. A similar configuration 1235 to that described in connection with the embodiment of FIG. 51 may be used to compress and expand the modules 1270.

Note that although in the above embodiments, the discussion is primarily related to the flow of air, it is clear that principles of the invention are applicable to any fluid.

Although in the embodiments described above and elsewhere in the specification, real-time control is described, it is recognized that some of the benefits of the invention may be achieved without real-time control. For example, the flow control device 120 may be set manually or periodically, but at intervals to provide the local load control without the benefit of real-time automatic control.

What is claimed is:

1. A combined filter/flow control device, comprising:

a filter unit having flow redirecting poxtions effective to remove suspended material from an air stream;

said redirecting portions including at least one vortex chamber configured to separate suspended particulate by centrifugal separation, said at least one vortex chamber having at least two selectable configurations, one restricting a flow of said air stream therethrough more than another.

2. A device as in claim 1, further comprising an actuator, engageable with said filter being selectively configurable by said actuator.

3. An exhaust hood with a combined filter/flow control device, comprising:

an intake hood with a permanent actuator and a support for receiving a replaceable filter unit having flow redirecting portions effective to remove suspended material from an air stream;

said actuator configured such that, upon the filter being received by said support, it engages said flow redirecting portions to provide at least two selectable configurations of said flow redirecting portions of said replaceable filter unit, one restricting a flow of an au stream therethrough through said replaceable filter unit more than another, said actuator forming a non-replaceable portion of said exhaust hood, whereby when said filter is replaced by another filter, said actuator reconfigures said another filter.

4. A device as in claim 1, wherein said filter unit is a disposable filter cartridge.

5. A filter device, comprising:

fluid flow conduit including inlet and outlet portions and a filter connecting the inlet and the outlet;

the filter being selectively configurable by b ending or pivoting portions thereof to provide selectable level of flow resistance to fluid flowing therethrough, whereby no abrupt flow transitions need be placed in said inlet or said outlet.

6. A device as in claim 5, wherein said inlet includes an exhaust hood.

7. A device as in claim 6, wherein said outlet includes an exhaust duct with a fan.

8. A device as in claim 5, wherein said filter includes at least one vortex chamber that separates particles from said fluid flowing therethrough by centrifugal separation principles.

9. A device as in claim 8, wherein said filter is selectively configurable such that, in a first configuration, said at least one vortex chamber ham a narrower diameter than in a second configuration.

10. A flow system providing fluid flowrate control and filtration, with no abrupt transitions by which suspended material may be removed from a fluid, except within a filter, comprising:

an inlet flow section;

an outlet flow section;

a filter support connecting said inlet flow section and said outlet flow section and supporting a filter separating said inlet and outlet flow sections such that a fluid flow from said inlet section to said outlet section passes through said filter;

a mechanism to change a flow restriction across said filter by modifying a path of said fluid through said filter;

an actuator engaged with said mechanism so as to selectively actuate said mechanism to change said flow restriction by bending or pivoting a portion thereof.

11. A system as in claim 10, wherein said portion includes an element that reduces a flow cross-section through said filter.

12. A system am in claim 11, wherein said portion includes a shutter.

13. A system as in claim 12, wherein said portion include at least one bendable portion.

14. A system as in claim 13, wherein said inlet is an exhaust hood.

15. A system as in claim 14, wherein said filter includes a vortex chamber and is adapted to extract grease from said fluid by means of centrifugal separation.

16. A system as in claim 10, wherein said mechanism Includes bendable portions of said filter such that bending said portion modifies said flow path.

17. A system as in claim 10, wherein said inlet is an exhaust hood.

18. A system as in claim 10, wherein said inlet includes a rungs hood and said filter is adapted to extract grease from said fluid.

19. A system as in claim 10, wherein said inlet includes a range hood.

20. A system as in claim 18, wherein said filter includes a replaceable cartridge.

21. A filter/flow controller, comprising:

a replaceable component with at least one air passage shaped to accelerate a flow of fluid such that suspended matter in said fluid is precipitated onto a surface of said at least one air passage;

said replaceable component including a mechanism adapted to change a flow resistance through said at least one air passage to regulate a flow therethrough;

a flow system including an actuator and upstream and downstream portions;

said replaceable component being adapted for installation in said flow system;

respective engagement portions on said replaceable component and said flow system adapted to connect and actuate said mechanism responsively to said actuator;

said flow system being configured such that substantially all suspended matter is precipitated out of said fluid in said at least one flow passage or upstream thereof such that no abrupt flow transitions occur downstream of said at least one air passage.

22. A filter/flow controller as in claim 21, wherein said at mechanism includes a shutter located upstream of said air passage portion.

23. A filter/flow controller as in claim 21, wherein said mechanism includes an effector in engagement with a wall portion of said at least one air passage with at least one flexible member, flexing of which causes a change in a flow cross section of said at least one air passage.

24. An exhaust hood flow balancing device, comprising:

a sensor indicating a flow rate through at least one of multiple exhaust hoods linked to a common exhaust;

a flow throttling device in a flow abeam of at least one of said multiple exhaust hoods located to control a volume rate therethrough;

a controller connected to control said flow throttling device to insure a selected balance of flow among said multiple hoods.

25. A device as in claim 24, wherein said selected balance is an equal flow rate among said multiple hoods.

26. A device as in claim 24, wherein said balance is a predetemined flow ratio responsive to a nominal load of respective ones of said multiple hoods.

27. A device as in claim 24, further comprising a fume load sensor connected to apply a fume load signal to said controller, said balance being determined responsively to said fume load sensor signal.

28. A device as in claim 27, wherein said fume load sensor includes a digital camera and image classifier, said camera being configured to image in at least one of infrared and optical ranges.

29. A device as in claim 28, wherein said image classifier is configured to identify a breach of a respective hood by a plume visible to said camera.

30. A device as in claim 27, wherein said fume load sensor includes at least one of an optical, temperature, opacity, audio, and flow rate sensor.

31. A device as in claim 24, wherein said multiple exhaust hoods include range hoods.

32. A replaceable flow-controlling filter comprising:

a removable cartridge having a filter portion for removing grease from a gas stream flowing therethrough, an inlet, and in adjustable flow volume control element;

a fixture with an actuator permanently affixable to an exhaust hood adapted for use with kitchen ranges, said actuator including a motor controllable by a control device;

said adjustable flow volume control clement having a portion engageable with said actuator when said removable cartridge is installed in said fixture to permit control of flow through said removable cartridge in response to said actuator.

33. A filter as in claim 32, wherein said filter portion includes a configurable channel to accelerate flow therethrough, an acceleration level thereof being adjusted by said adjustable volume control element such that a grease extraction effectiveness is enhanced thereby.

34. A filter as in claim 32, wherein said cartridge includes a shutter at said inlet.

35. A filter as in claim 34, wherein said shutter is slideable with respect to a remainder of said cartridge.

36. A filter as in claim 32, wherein said filter portion includes a vortex chamber and said adjustable flow volume control element includes wall of said vortex chamber, a diameter of said vortex chamber being selectable to vary a pressure drop through said cartridge.

37. A filter as in claim 32, wherein said adjustable flow volume control element includes a pivoting cover over an outlet thereof.

38. A flow-throttling device for use with a kitchen hood having a canopy, a canopy interior, and one or more exhaust duct(s), with each exhaust duct connected by a vent to provide communication to said canopy interior, said flow-throttling device enabling control of a flow rate in each of said exhaust duct(s) without generating abrupt flow transitions therein, said flow-throttling device comprising:

a replaceable cartridge filter located within a blind end of said canopy interior;

said replaceable cartridge filter having one or more support elements with one or more flow control elements connected to said one or more support elements, said flow control elements being selectively movable relative to said replaceable cartridge filter and located to selectively block flow at and through an inlet of said replaceable cartridge filter.

39. A flow-throttling device for use with a kitchen hood having a canopy, a canopy interior, and one or more exhaust duct(s), with each exhaust duct connected by a vent to provide communication to said canopy interior, said flow-throttling device enabling control of flow rate in each of said exhaust duct(s) without generating abrupt flow transitions therein, said flow-throttling device comprising:

one or more support elements connected to the canopy;

a grease filter with at least one gas inlet receiving gas flow through an inlet facing the vent and releasing gas through at least one outlet communicating with said one or more exhaust duct(s);

one or more flow control elements connected to the support elements and positioned adjacent to the at least one outlet of the grease filter and positioned outside the grease filter, said one or more flow control elements enabling selective blocking of the at least one outlet of the grease filter;

said grease filter, said support elements and said flow control elements being located in the upstream portion of said one or more exhaust duct(s), whereby only smooth transitions are located within the body of said one or more exhaust duct(s) while permitting control of flow.

* * * * *